US006309269B1

(12) United States Patent
Fulton et al.

(10) Patent No.: US 6,309,269 B1
(45) Date of Patent: Oct. 30, 2001

(54) VARIABLE BUOYANCY BUOY FOR MOORING MOBILE OFFSHORE DRILLING UNITS

(75) Inventors: Thomas M. Fulton, Katy; Peter George Scott Dove, Magnolia; Gordon R. Wilde, Houston; Johannes Jacobus Treu, Bellville, all of TX (US)

(73) Assignee: Aker Marine, Inc., Houston, TX (US)

( * ) Notice: Subject to any disclaimer, the term of this patent is extended or adjusted under 35 U.S.C. 154(b) by 0 days.

(21) Appl. No.: 09/307,295

(22) Filed: May 7, 1999

Related U.S. Application Data

(62) Division of application No. 08/948,227, filed on Oct. 9, 1997, now Pat. No. 6,009,825.

(51) Int. Cl.[7] ..... B63B 21/00

(52) U.S. Cl. ..... 441/1; 441/6; 441/21; 114/293; 405/171

(58) Field of Search ..... 405/171; 441/1, 441/6, 21, 23; 114/230.2, 293

(56) References Cited

U.S. PATENT DOCUMENTS

| | | | | |
|---|---|---|---|---|
| 421,686 | * | 2/1890 | Fagan et al. | 441/6 |
| 1,295,008 | * | 2/1919 | Corley | 441/1 |
| 1,320,604 | * | 11/1919 | Dame | 441/1 |
| 3,295,489 | | 1/1967 | Bossa | 114/230 |
| 3,411,473 | | 11/1968 | Mott et al. | 114/296 |
| 3,431,879 | | 3/1969 | Westling | 405/224 X |
| 3,540,396 | | 11/1970 | Horton | 114/0.5 |
| 3,602,174 | | 8/1971 | Gorman | 114/0.5 |
| 3,703,151 | | 11/1972 | Clement | 114/230 |
| 4,024,718 | | 5/1977 | Roche et al. | 405/190 |
| 4,075,862 | * | 2/1978 | Ames | 405/171 X |
| 4,086,866 | | 5/1978 | Nixon | 114/295 |
| 4,107,933 | * | 8/1978 | Lamy | 405/171 |
| 4,155,673 | * | 5/1979 | Yashima | 114/293 X |
| 4,164,195 | | 8/1979 | Frigeni | 114/322 |
| 4,222,591 | | 9/1980 | Haley | 285/920 X |
| 4,257,721 | | 3/1981 | Haynes | 405/227 |

(List continued on next page.)

FOREIGN PATENT DOCUMENTS

| | | | |
|---|---|---|---|
| B-53363/79 | 11/1979 | (AU) . | |
| 0 011 894 | 4/1984 | (EP) . | |
| 610714 | 5/1978 | (SU) | 114/296 |
| 797955 | 1/1981 | (SU) | 114/296 |

OTHER PUBLICATIONS

Telefax memo from Aker Omega Marine, Inc. to Shell Offshore, Inc. dated May 7, 1991.

Telefax memo from Aker Omega Marine, Inc. to Shell Offshore, Inc. dated Jun. 17, 1991.

*Pre–set Moorings Provide Less Costly Alternative to DP in Ultra–Deepwater*, Peter G.S. Dove & Thomas M. Fulton, Aker Marine Contractors, *Offshore*, May 1997 pp 76–80.

*Why Mobile Drilling Units Will be Able to Moore in 10,000 ft. Depths*, Peter G.S. Dove & Thomas M. Fulton, Aker Marine Contactors, *Offshore*, Apr. 1997, pp 32–34.

*Mooring Descent Deeper*, Peter Dove & Thomas Fulton, Aker Marine Contractors, *Offshore Engineer*, Mar. 1997, pp 47–48.

*Primary Examiner*—David Bagnell
*Assistant Examiner*—Jong-Suk Lee
(74) *Attorney, Agent, or Firm*—Gardere Wynne Sewell LLP

(57) ABSTRACT

In a system for mooring offshore drilling units, a first mooring assembles installed at a first drilling venue, after which the mobile offshore drilling unit is moored by con nection to the mooring lines. A second mooring assembly is installed at a second drilling venue while drilling operations are carried out at the first drilling venue. In this manner the mobile offshore drilling unit can be relocated between successive drilling venues with minimum down time. Less than complete mooring assemblies can be used to temporarily secure the mobile offshore drilling unit.

12 Claims, 28 Drawing Sheets

U.S. PATENT DOCUMENTS

| | | | | |
|---|---|---|---|---|
| 4,318,641 | | 3/1982 | Hogervorst | 405/224 |
| 4,347,012 | | 8/1982 | Glidden | 403/2 |
| 4,432,671 | | 2/1984 | Westra et al. | 405/226 |
| 4,439,068 | | 3/1984 | Poklandnik | 166/338 X |
| 4,572,304 | | 2/1986 | Mahar et al. . | |
| 4,575,282 | | 3/1986 | Pardue, Sr. et al. | 405/228 |
| 4,601,608 | | 7/1986 | Ahlstone | 285/920 X |
| 4,635,728 | | 1/1987 | Harrington | 166/341 |
| 4,669,989 | * | 6/1987 | Havlick | 441/1 |
| 4,721,415 | | 1/1988 | Shatto | 405/224.1 |
| 4,733,993 | | 3/1988 | Andréasson | 405/224 |
| 4,830,541 | | 5/1989 | Shatto | 405/226 |
| 4,940,362 | | 7/1990 | Paulshus et al. | 405/224 |
| 5,041,038 | | 8/1991 | Poldervaart et al. | 440/5 |
| 5,097,788 | * | 3/1992 | Castel | 114/293 |
| 5,159,891 | | 11/1992 | Lohr et al. | 114/230 |
| 5,190,107 | * | 3/1993 | Langner et al. | 441/3 X |
| 5,364,297 | * | 11/1994 | Rohardt | 441/23 |
| 5,480,521 | | 1/1996 | Snyder, Jr. et al. | 166/338 X |
| 5,704,307 | | 1/1998 | Treu et al. | 114/230 |
| 5,893,334 | * | 4/1999 | Poranski, Sr. | 114/230.2 |

* cited by examiner

VARIABLE BUOYANCY BUOY FOR MOORING MOBILE OFFSHORE DRILLING UNITS

This application is a division of pending application No. 08/948,227 filed Oct. 9, 1997, U.S. Pat. No. 6,009,825.

TECHNICAL FIELD

This invention relates generally to mooring systems, and more particularly to recoverable systems for mooring mobile offshore drilling units in deep water.

BACKGROUND AND SUMMARY OF THE INVENTION

As is well known, exploration for and recovery of oil and gas has long since extended into offshore venues. Early offshore drilling operations were concentrated in relatively shallow waters. However, the number of shallow water drilling sites is finite, while the world's appetite for oil and gas is seemingly unlimited. It has therefore become necessary to conduct offshore drilling operations in waters as deep as 10,000 feet or more.

Offshore drilling operations are frequently conducted from floating platforms known as mobile offshore drilling units (MODUs). While the mooring of offshore drilling units in shallow water is relatively straightforward, the successful mooring of MODUs in deeper water can be problematic.

The traditional method of mooring MODUs in deeper water involves the use of drag embedment anchors and mooring lines which are stored on the MODU, and which are deployed from the MODU using anchor handling vessels. Some of the latest generation MODUs can carry adequate lengths of wire and chain on board, and are equipped with combination wire/chain mooring winches to moor at maximum depths of 5,000 feet of water. Large anchor handling vessels are capable of deploying and recovering such mooring legs and anchors. In even deeper water, however, the amount of wire and chain that would have to be carried on the MODU becomes too large, and even large anchor handling vessels would have difficulty deploying and recovering such mooring systems in the traditional manner.

Older generation MODUs typically cannot carry enough mooring line to moor in water deeper than about 2,000 to 3,000 feet. This water depth limit can be extended by inserting sections of wire in each mooring leg, or by pre-installing mooring legs prior to arrival of the MODU at location. Both types of extended water depth mooring legs (insert or preset) typically use modern high holding power drag embedment anchors. Large anchor handling vessels are used to install the wire inserts during mooring leg deployment or to pre-install the preset mooring legs.

One drawback to deep water MODU moorings using drag embedment anchors is that such anchors typically cannot handle uplift (vertical load), which requires both that the mooring leg is very long, and that the anchor is set very far from the MODU. In water depths over 6,000 feet the horizontal distance to the anchors can become a problem, since it could be as large as 12,000 feet or 2 nautical miles, and each mooring leg could be as long as 15,000 feet or 2.5 nautical miles. This requires an anchor spread diameter of about 4 nautical miles.

If an anchor system can be used which can handle substantial uplift or vertical load, the anchor radius and mooring line length can be reduced significantly. Driven anchor piles are capable of handling uplift, but cannot be installed in deep water nor are they recoverable. For this reason, driven anchor piles have never been used for MODU moorings.

Mooring systems employing anchors other than drag embedment anchors and driven piles have been proposed heretofore. For example, U.S. Pat. No. 4,318,641, granted to Hogervorst on Mar. 8, 1982, discloses mooring systems employing suction embedment anchors, which are capable of taking significant uplift or vertical load. However, prior to the present invention, there has not been provided a successful system for installing and recovering suction anchors in very deep water thereby facilitating ultra deep water drilling operations.

The present invention comprises a system for mooring mobile offshore drilling units which overcomes the foregoing and other difficulties long since associated with the prior art. In accordance with the broader aspects of the invention, mobile offshore drilling units are moored using anchors which are recoverable and reusable upon the completion of drilling operations. In accordance with a preferred embodiment of the invention, recoverable suction anchors are employed, and in accordance with another embodiment of the invention vertically loaded anchors are employed. Recoverable drag embedment anchors can also be used in the practice of the invention, if desired.

Regardless of the anchor type employed, the present invention comprises a method of mooring MODUs wherein a first set of recoverable preset mooring legs with suitable anchors are pre-installed at spaced apart locations surrounding an offshore drilling venue. After the recoverable preset mooring legs are installed, a MODU is positioned at the drilling venue, and connected to the preset mooring legs by short lengths of the mooring chain or-wire extending from mooring winches on the MODU.

While drilling operations are being conducted from the MODU, a second set of mooring legs is preset at spaced apart locations around a second drilling venue. When drilling operations have been completed at the first drilling venue, the mobile offshore drilling unit is moved from the first drilling venue to the second drilling venue, and is secured in place at the second drilling venue by connection to the second set of preset mooring legs surrounding the second drilling venue. The mobile offshore drilling unit is then used to conduct drilling operations at the second drilling venue in the usual manner.

While drilling operations are being conducted at the second drilling venue, the first set of mooring legs is recovered from the first drilling venue and is moved to a third drilling venue. The mooring legs from the first drilling venue are then preset at spaced apart locations surrounding the third drilling venue with the installation thereof being completed prior to the movement of the mobile offshore drilling unit from the second drilling venue to the third drilling venue. This process continues until drilling operations have been completed at all of the drilling venues within a particular area, whereupon all of the mooring legs and the MODU are removed to a different area.

The present invention may also be practiced using less than two complete sets of mooring legs. In such instances, a reduced number of mooring legs, for example, one half of a complete set, is installed at a second drilling venue. The MODU is then moored to the second drilling venue and secured in place using the preset mooring legs then in place. Next, the remainder of the mooring legs comprising a complete set are installed, whereby the MODU is fully secured. This procedure is repeated until drilling operations are completed at a particular location.

BRIEF DESCRIPTION OF THE DRAWINGS

A more complete understanding of the present invention may be had by reference to the following Detailed Description when taken in connection with the accompanying Drawings wherein.

DETAILED DESCRIPTION

Figure 1:
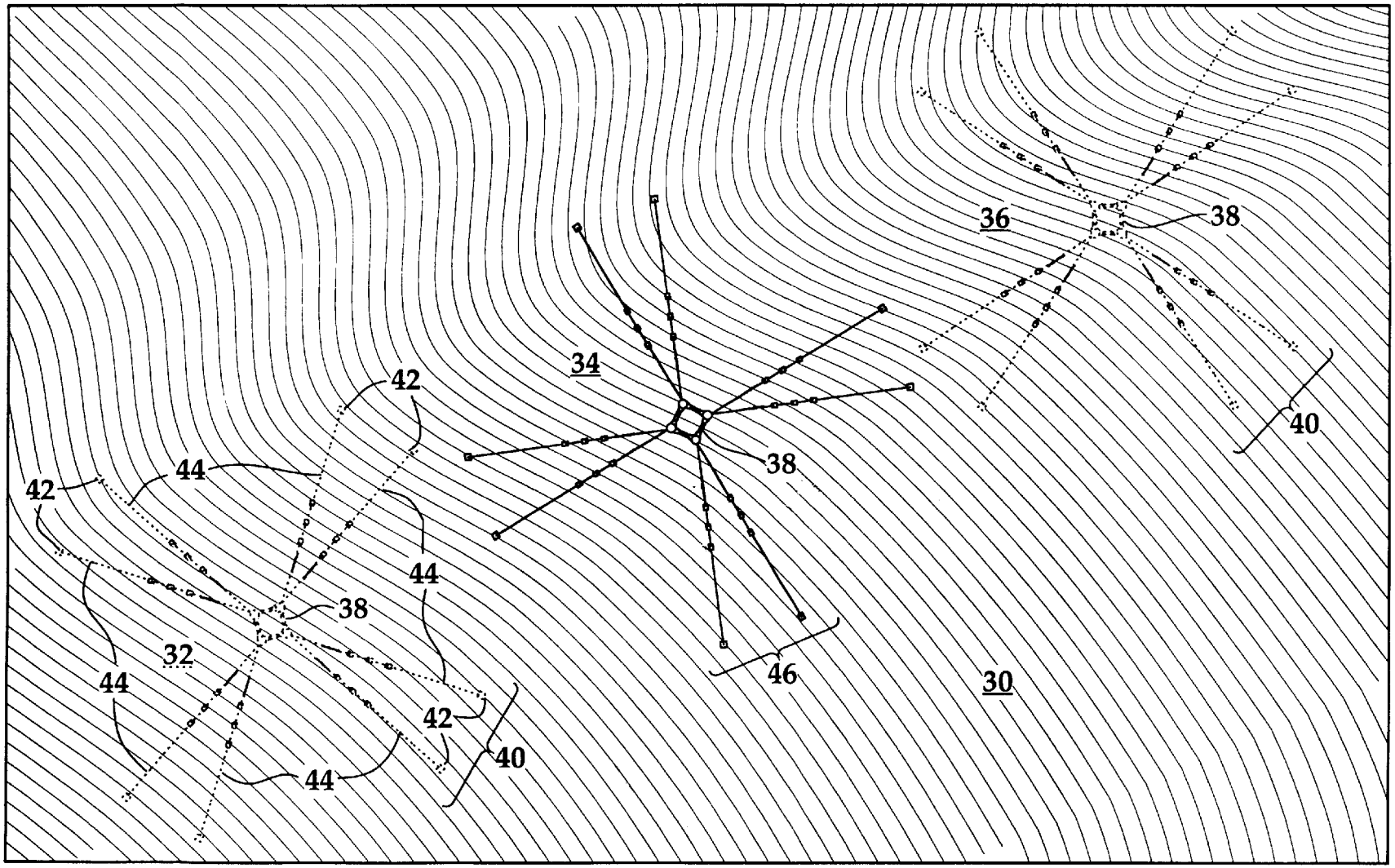
FIG. 1 is a diagrammatic illustration of the method of mooring mobile offshore drilling units comprising the present invention.

Referring now to the Drawings, and particularly to FIG. 1 thereof, there is shown an area 30 comprising a portion of the ocean or other water body suitable for underwater drilling operations. Area 30 includes at least three drilling venues, 32, 34, and 36. Venue 32 comprises a previously drilled location at which drilling operations have been completed. Venue 34 comprises a current drilling location wherein drilling operations are currently underway. Venue 36 comprises a yet-to-be drilled location at which drilling operations have not yet begun.

In accordance with the present invention, a mobile offshore drilling unit 38 (MODU) is employed to conduct drilling operations at venues 32, 34, and 36. During the time that drilling operations were in progress at venue 32, the mobile offshore drilling platform 38 was secured in place at venue 32 by a first mooring assembly 40 comprising a plurality of mooring legs 42 each including a mooring line 44 connected to the mobile offshore drilling unit 38. Although the mooring assembly 40 is illustrated as comprising eight mooring legs 42, it will be understood that the invention is not limited to any particular number of mooring legs, with the actual number employed being dependent upon the requirements of particular applications of the invention, and that in some cases 9, 10, or more mooring legs will be required in order to properly moor a particular MODU.

After drilling operations are completed at drilling venue 32, the mobile offshore drilling unit 38 is disengaged from the first mooring assembly 40 and is towed or otherwise repositioned at drilling venue 34. Prior to the repositioning of the mobile offshore drilling unit 38 from venue 32 to venue 34, a second mooring assembly 46 also comprising mooring legs 42 including mooring lines 44 extending therefrom is preset at venue 34. The use of multiple mooring assemblies and the installation thereof at drilling venues prior to the positioning of the mobile offshore drilling unit at the drilling venue comprises an important feature of the invention in that it allows the mobile offshore drilling unit to be secured in place and ready for operation very rapidly.

After the mobile offshore drilling unit 38 has been disengaged therefrom, the first mooring assembly 40 is recovered from drilling venue 32 and is transported to drilling venue 36. The mooring legs 42 and the mooring lines 44 associated therewith comprising the first taut-leg mooring assembly 40 are preset at drilling venue 36 while drilling operations are progressing at drilling venue 34. Later, after drilling operations are completed at drilling venue 34, the mobile offshore drilling unit 38 is disconnected from the mooring assembly 46 and is towed or otherwise repositioned at drilling venue 36. The mobile offshore drilling unit 38 is then secured in place at drilling venue 36 utilizing the first mooring assembly 40. The foregoing steps are repeated until drilling at all of the venues comprising a particular one has been completed, whereupon the mooring assemblies and the MODU are moved to a different area.

FIG. 1 further illustrates two alternative procedures for mooring MODUs in accordance with the present invention. The first alternative procedure involves the use of a single mooring assembly, for example, the mooring assembly 40. The mobile offshore drilling unit 38 is initially secured at the first drilling venue 32 utilizing the mooring assembly 40, including all of the mooring legs 42 thereof.

After drilling operations are completed at the first drilling venue 32, half of the mooring legs 42 comprising the mooring assembly 40 are disengaged and are repositioned at the second drilling venue 34. The mobile offshore drilling unit 38 is then repositioned to the second drilling venue 34 and is secured in place utilizing the drilling legs 42 comprising part of the mooring assembly 40 which have been preset at the second drilling venue 34. Thereafter, the remainder of the drilling legs 42 comprising the mooring assembly 40 are installed at the second drilling venue 36, whereupon the mobile offshore drilling unit 38 is fully secured. This procedure is repeated until all of the drilling venues in a particular area have been drilled, after which the mooring legs 42 comprising the mooring assembly 40 are recovered and the mooring assembly 40 and the mobile offshore drilling unit 38 are removed to a new drilling area.

The second alternative procedure involves the use of one complete mooring assembly 40 and a second mooring assembly 46 comprising, for example, one half of the number of mooring legs utilized in the complete mooring assembly 40. The mobile offshore drilling unit 38 is initially secured in place at the first drilling venue 32 utilizing the complete mooring assembly 40. While drilling operations are in progress at the first drilling venue 32, the partial mooring assembly 46 is preset at the second drilling venue 34.

Upon completion of drilling operations at the first drilling venue, the mobile offshore drilling unit 38 is relocated to the second drilling venue 34 and is secured in place utilizing the mooring legs 42 comprising the partial mooring assembly 46. Thereafter, half of the mooring legs 42 from the complete mooring assembly 40 are installed at the second drilling venue 34, whereupon the mooring assembly 46 becomes a complete mooring assembly and the mooring assembly 40 becomes a partial mooring assembly. During the time that drilling operations are in progress at the second drilling venue 36, the partial drilling assembly 40 is preset at the third drilling venue 36.

After drilling operations are completed at the second drilling venue 34, the mobile offshore drilling unit 38 is repositioned to the third drilling venue 36 and is secured in place by the drilling legs 42 comprising the partial drilling assembly 40. Thereafter, half of the mooring legs comprising the taut-leg mooring assembly 46 are installed at the third drilling venue 36. This procedure is repeated until all of the drilling venues at a particular drilling location have been drilled, whereupon all of the drilling legs comprising the drilling assemblies 40 and 46 are recovered and are moved to a new drilling area along with the mobile offshore drilling unit 38.

Figure 2:
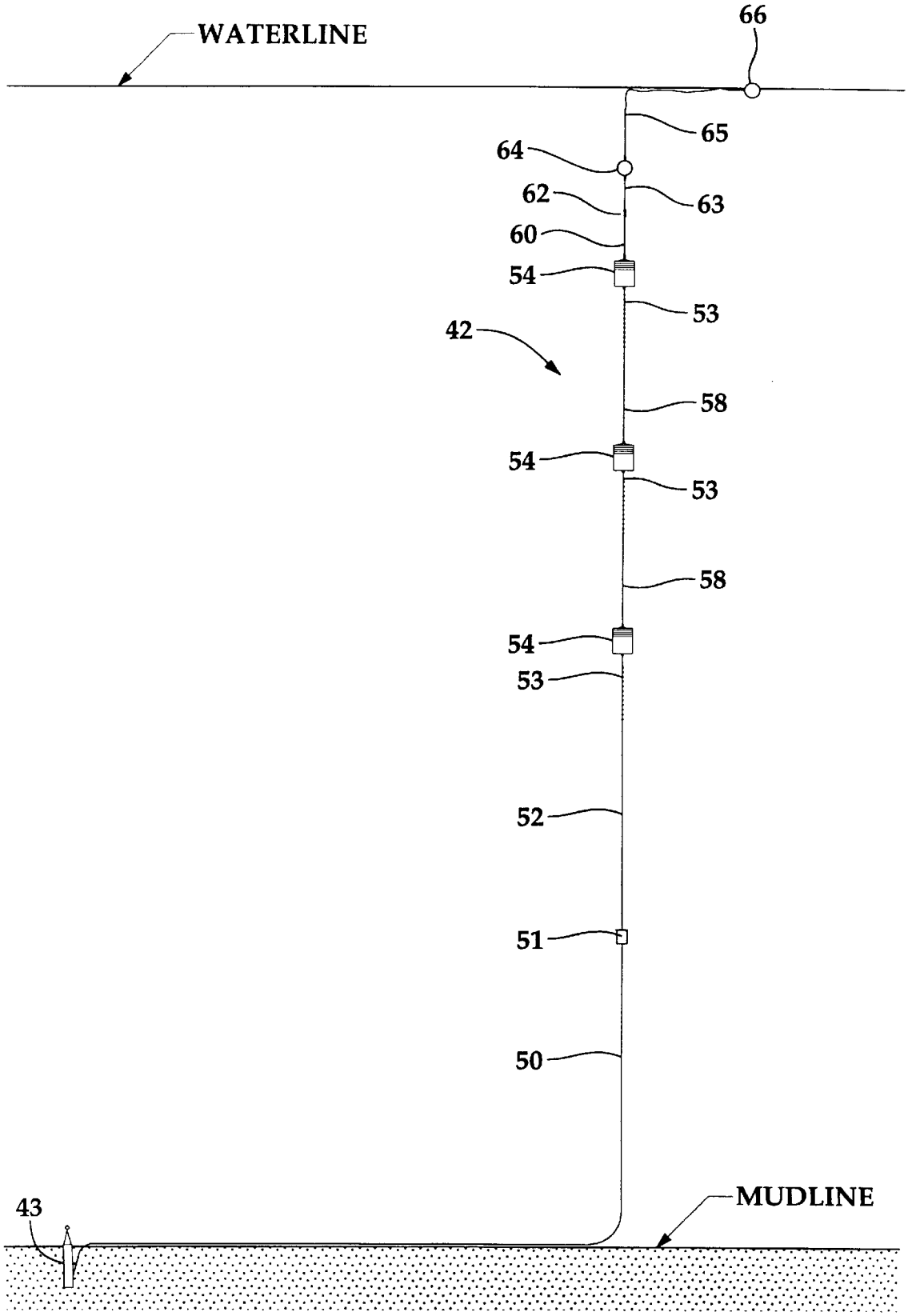
FIG. 2 is an illustration of a preset taut mooring leg with a recoverable anchor in its pre-installed configuration useful in the practice of the invention.

Referring now to FIG. 2, the mooring legs 42 and the is mooring lines 44 associated therewith comprising the mooring assemblies 40 and 46 are illustrated in greater detail. The mooring legs 42 preferably comprise taut-leg mooring legs which include suction anchors 43 constructed either from steel or from concrete. For example, a steel suction anchor comprising a cylindrical tube 12 feet in diameter, 60 feet in length, and having a wall thickness of 1 and ½ inches may be utilized in the practice of the invention. Special drag embedment anchors designed for high vertical loading, also known as Vertically Loaded Anchors (VLAs) may also be utilized in the practice of the invention, if desired.

In the case of a drilling venue having a water depth of 7,500 feet, the mooring line 44 of each mooring leg 42 comprises a 5,500-foot long, 3.88-inch diameter first segment of riser line 50 attached to and extending from the anchor 43. A 4 and ½-inch diameter connecting link 51 of the type manufactured by Kenter, Baldt, Bruce, or Ramnäs is attached to the distal end of the riser line 50. A 5,500-foot second segment of riser line 52 is attached at its proximal end to the connecting link 51. A 3.38-inch diameter, 15-feet long, buoy pigtail chain 53 is attached to the distal end of riser line segment 52. A plurality of submerged buoys 54 having a 145-kip total net buoyancy are attached to the distal end of the buoy pendent wire 53.

Below each buoy 54 there is a 15-foot×3.38-inch chain section 53, and there is a 100-foot×3.88-inch wire rope pendant 58 between the buoys 54. A 3.88-inch diameter, 50-foot length of wire 60 extends from the upper buoy 54 to a connector 62. A 15-foot 2.5-inch diameter wire 63 extends from the connector 62 to a submerged buoy 64 having a buoyancy of between about 3 and about 5 kips. A buoyant line 65 formed from synthetic material, for example Samson® ultrablue 3.5-inch diameter line extends to a floating marker buoy 66.

Figure 3:
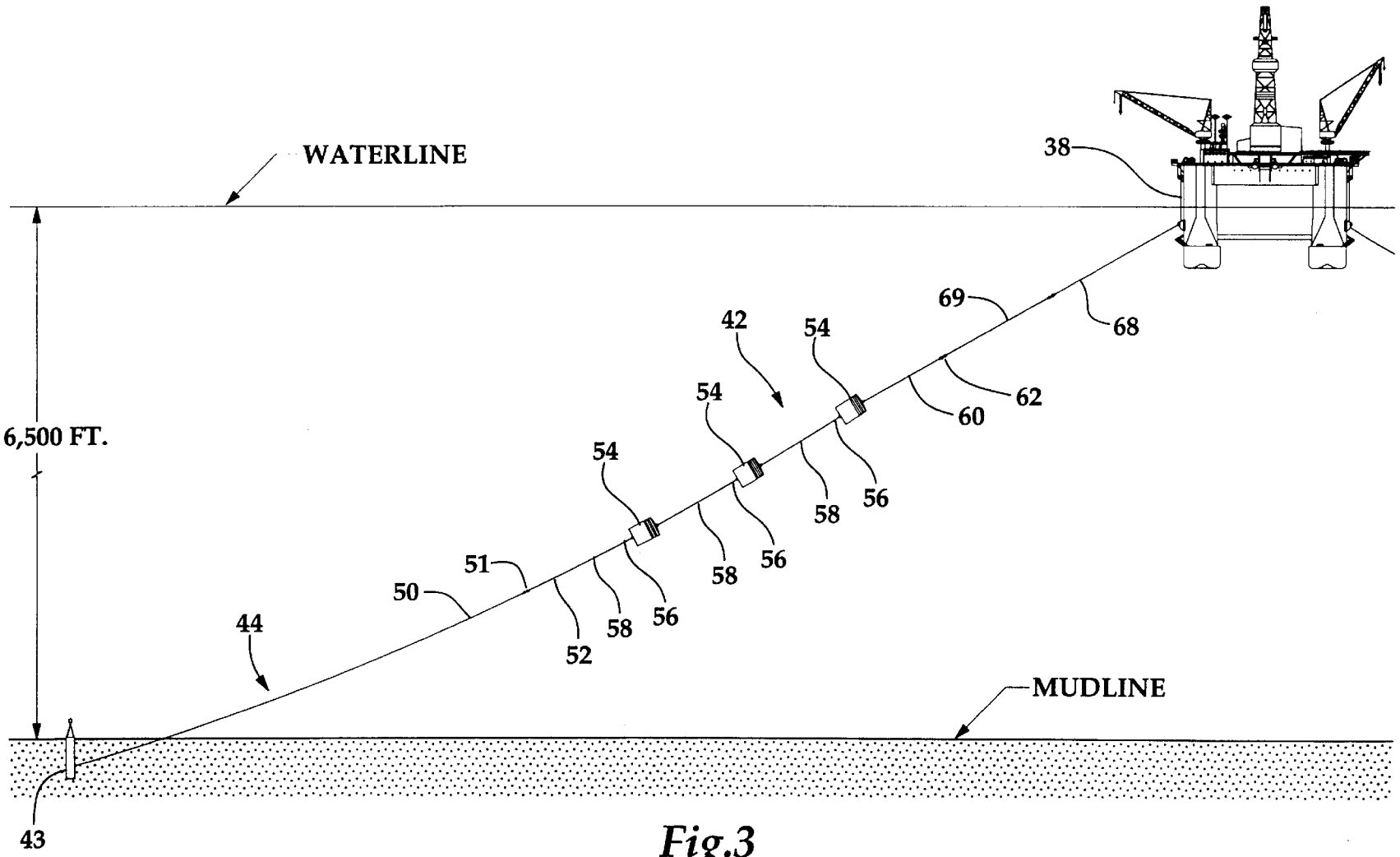
FIG. 3 is a view similar to FIG. 2 showing the mooring leg attached to a mobile offshore drilling platform.
Figure 4:
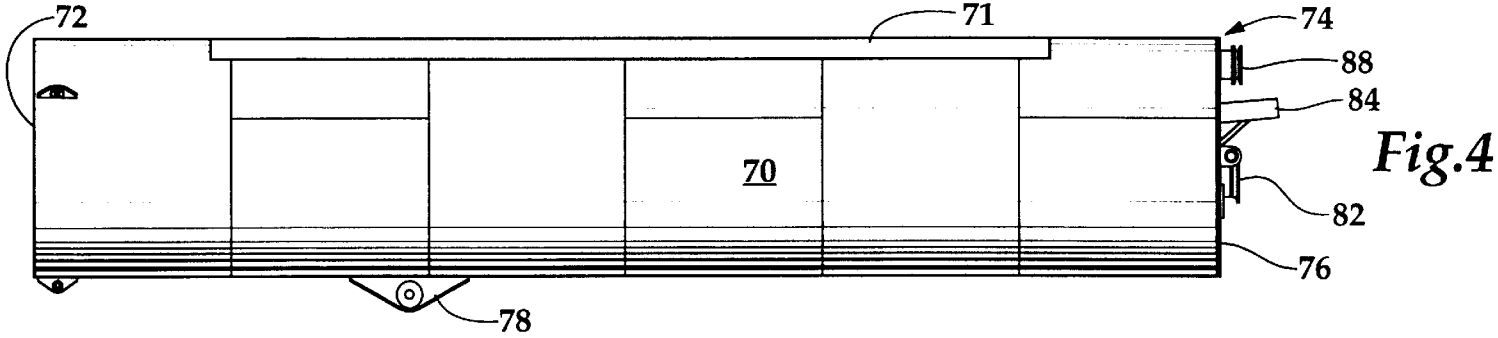
FIG. 4 is a side view of a suction anchor useful in the practice of the invention.
Figure 5:
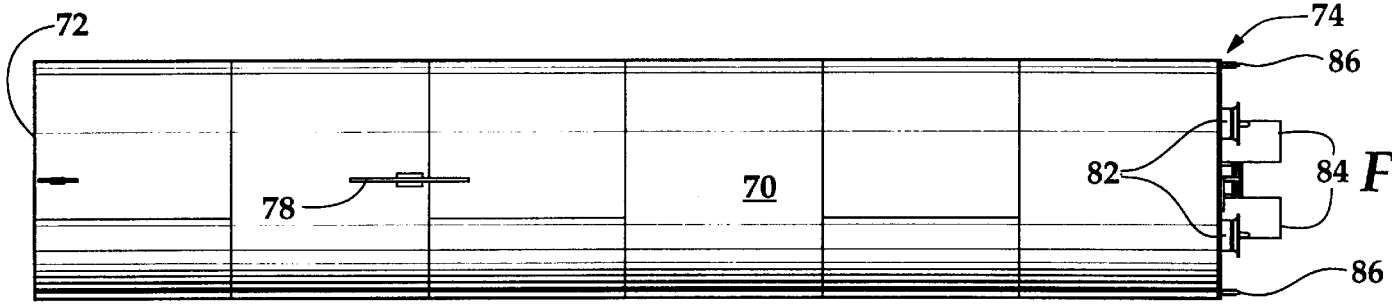
FIG. 5 is an illustration similar to FIG. 4 wherein the suction anchor is rotated 90 degrees.
Figure 6:
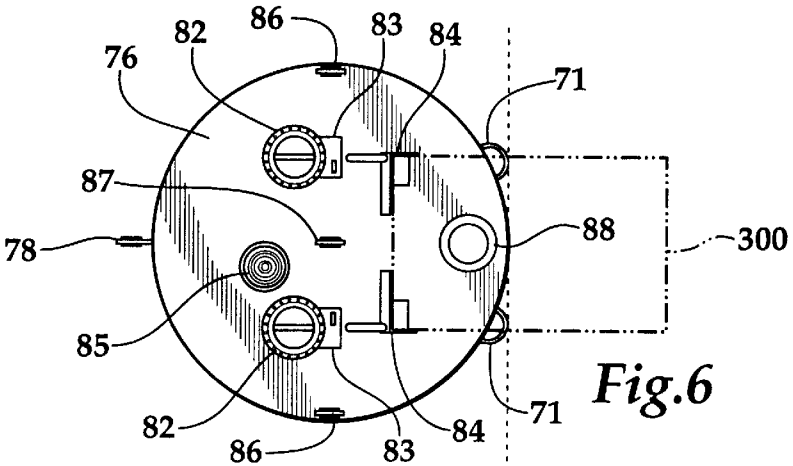
FIG. 6 is a top view of the suction anchor of FIG. 4.
Figure 7:
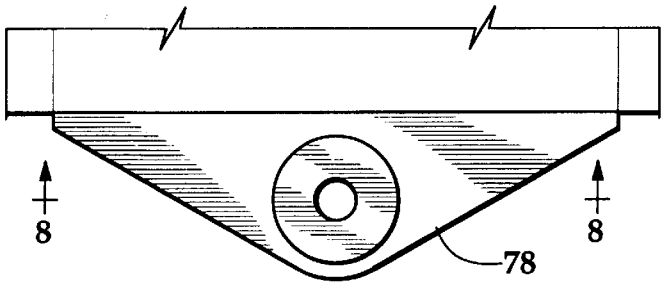
FIG. 7 is an enlargement of the pad eye of the suction anchor of FIG. 4.
Figure 8:
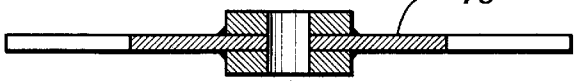
FIG. 8 is a sectional view of the pad eye of FIG. 7.

In FIG. 3 there is illustrated the connection of the mooring line 44 to the mobile offshore drilling unit 38. A 3.88-inch diameter wire 68 of about 800 feet length deployed by the MODU from its mooring winch, and secured to a 150-foot long×3.38-inch diam. K4 chain 69, which is inserted by the hook-up vessel between the preset mooring line and the MODU's mooring wire. The line 63, the submerged buoy 64, the line 65, and the floating marker buoy 66 are removed when the MODU 38 is connected to the taut-leg mooring leg 42.

It will be understood that the foregoing indications of length, diameter, and type of the component parts of the mooring line 44 are representative only, and that the actual dimensions of the component parts of the mooring line 44 will depend at least on three factors: first, the depth of the water in which the mooring line is used; second, the particular material selected for use in the fabrication of each component part of the mooring line 44; third, the size of the MODU. It will be further understood that the use of one or more submerged buoys 54 as a component part of each mooring line 44 comprises an important feature of the invention in that it allows the mobile offshore drilling unit 38 to be secured rapidly in place by a taut-leg mooring system. In addition, the use of the buoys 54 significantly improves the performance of the taut-leg mooring system and reduces the vertical loads imposed on the MODU by the mooring legs.

Turning now to FIGS. 4 through 8, therein is shown a steel suction anchor 70 useful in the practice of the invention. The suction anchor 70 is a right circular cylinder 12 feet in diameter and 60 feet in length, having a wall thickness of 1.5 inches. Skids 71, which may comprise lengths of angle iron or lengths of pipe cut in half longitudinally are welded to the cylinder comprising the anchor 70 to prevent it from rolling on the deck of the installation vessel.

The suction anchor 70 is open on the lower end 72 and closed at the upper end 74 by a plate 76. A pad eye 78, for receiving mooring line 44, is attached on an exterior side of suction anchor 70 approximately 40 feet from the top. The top closure plate 76 on the upper end 74 of suction anchor 70 includes ports 82 which allow water to flow through the closure plate 76 as the anchor 70 heaves up and down during lowering to and retrieval from the sea floor. The ports 82 are opened and closed by worm gear actuators 83 which are in turn operated by a manipulator extending from a remote operation vehicle (ROV) 300 which is located relative to the skid 80 by docking posts 84.

Alignment of the anchor 70 is determined using a camera on the ROV 300 which observes a bullseye level 85. The ROV 300 also adjusts the horizontal alignment of the suction anchor 70 by checking the suction anchor's heading with a gyrocompass on board the ROV. If the horizontal alignment is out of tolerance, the ROV 300 rotates the suction anchor 70 by activating thrusters on the ROV. The placement of the ROV 300 on the outer edge of the closure plate 80 ensures that the ROV's thrusters can apply adequate torque to rotate the suction anchor 70 about its axis.

Pad eyes 86 are used to connect the anchor to a recovery bridle. An alternate pad eye 87 may be used with a single recovery pendant or with double recovery sling. A suction port 88 having a clamp down hub is engaged by the ROV 300 to effect pumping of water into or out of the anchor 70.

Figure 9:
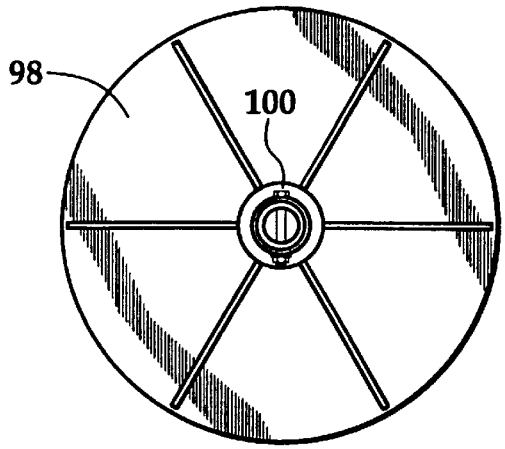
FIG. 9 is a top view of a submerged buoy useful in the practice of the invention.
Figure 10:
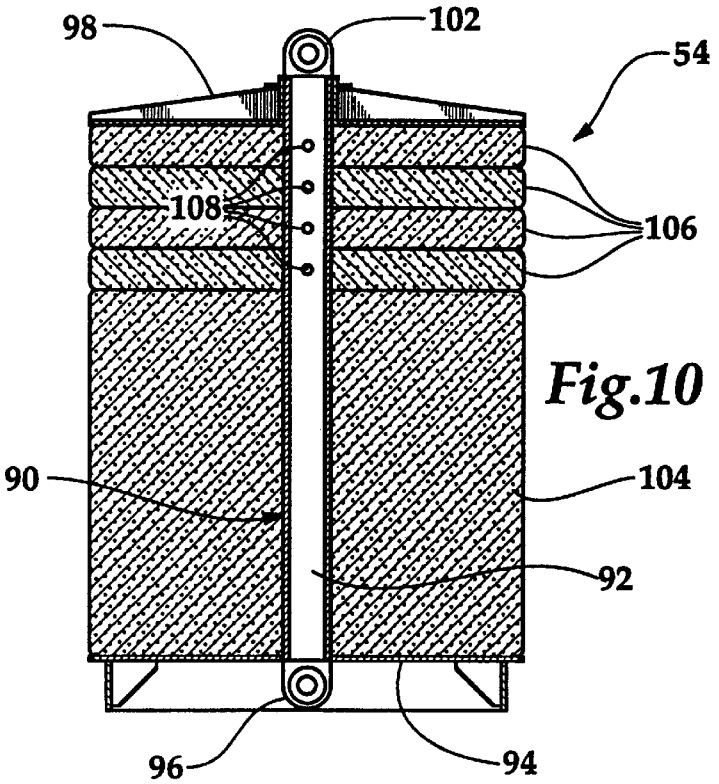
FIG. 10 is a longitudinal sectional view of the buoy of FIG. 9.
Figure 11:
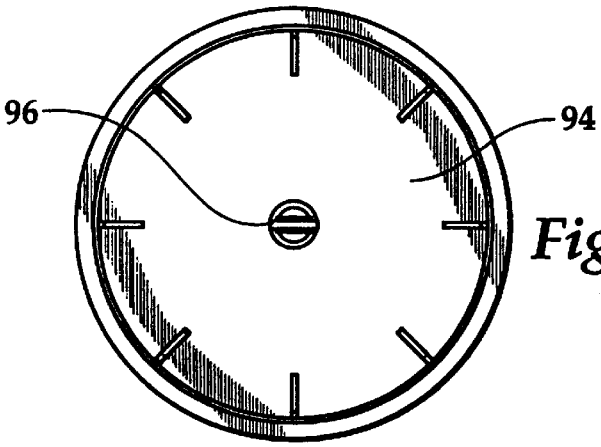
FIG. 11 is a bottom view of the buoy of FIG. 9.

The submerged buoys 58 utilized in the mooring lines 44 are further illustrated in FIGS. 9, 10, and 11. Each buoy 54 comprises a frame 90 including a hollow central shaft 92 and a bottom plate 94 secured thereto. A pad eye 96 is secured at the bottom of the shaft 92 for use in securing the buoy 54 in the mooring line 44. A top plate 98 is mounted at the upper end of the shaft 92 and is secured in place by a bolt 100. The upper end of the shaft 92 is provided with a pad eye 102 for use in securing the buoy 58 in. the mooring line 44.

The buoy 58 further comprises a primary buoyancy member 104 and a plurality of auxiliary members 106 which are added to or removed from the buoy 54 depending on the amount of buoyancy required by the water depth and the particular applications of the invention. All of the buoyancy members 104 and 106 comprise syntactic foam. An outer protective layer of glass reinforced polyester may be provided around the buoyancy members 104 and 106, if desired. It will be understood that the top plate 98 is secured in place on the buoy 54 by extending the bolt 100 through selected holes 108 formed in the shaft 92 depending upon the number of auxiliary buoyancy members 106 that are utilized in a particular application of the invention.

Figure 12:
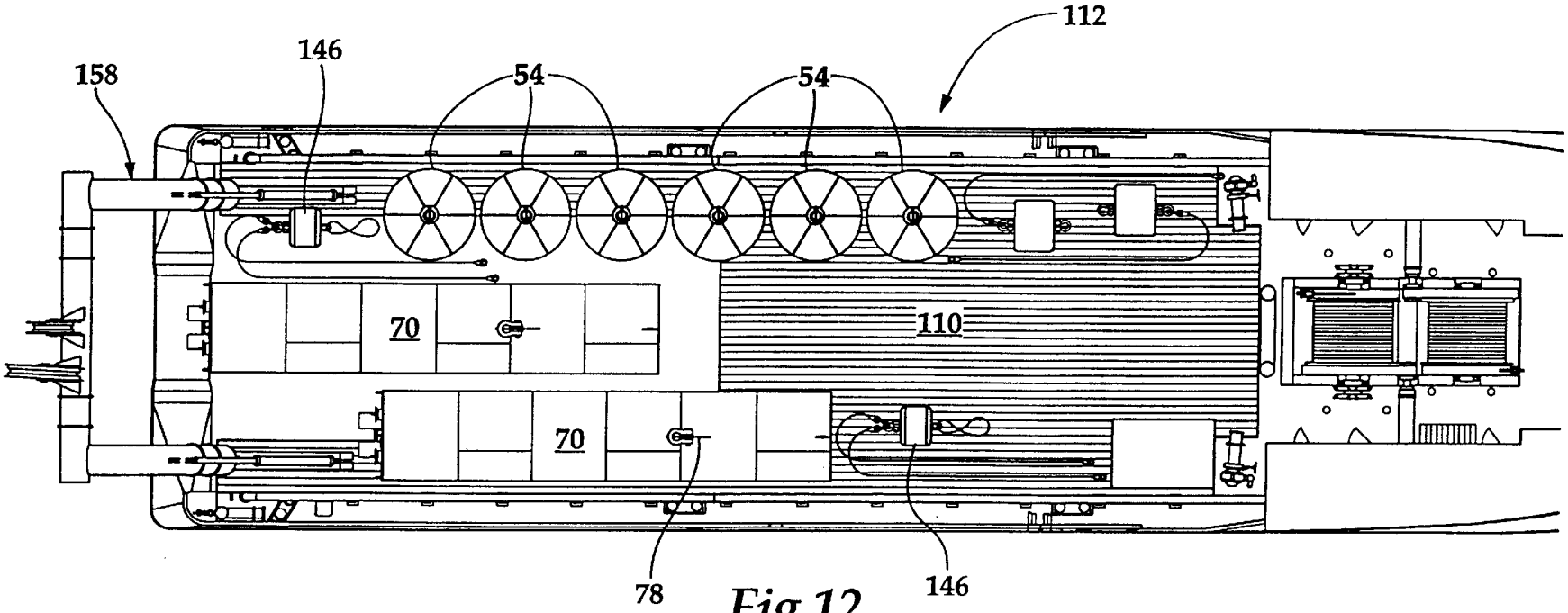
FIG. 12 is a top view of an installation vessel useful in the practice of the invention.
Figure 13:
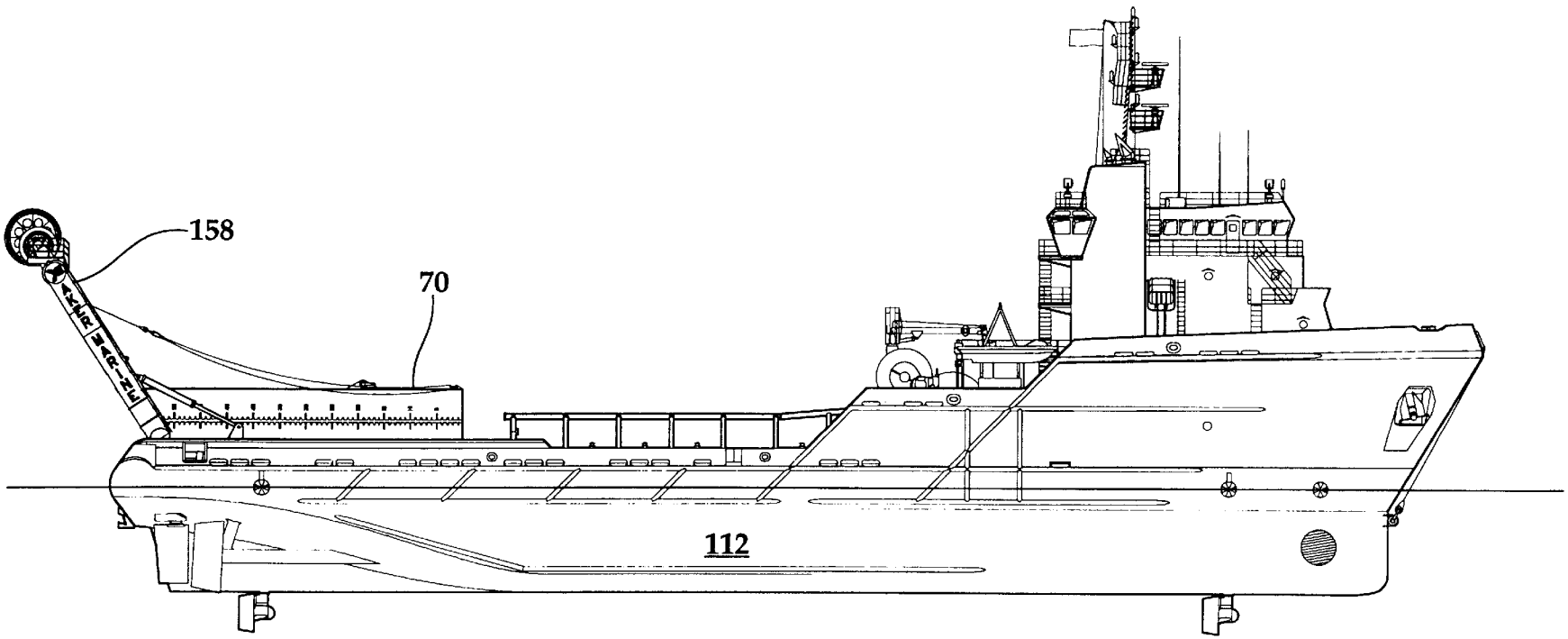
FIG. 13 is a side view of the vessel of FIG. 12.

Referring now to FIG. 12, therein is illustrated a top view of the deck 110 of an installation vessel 112. The deck 110 of the vessel 112 supports suction anchors 70 during transportation to a drilling venue. FIG. 13 is a side view of the transportation vessel 100 and the anchors 70.

Figure 14:
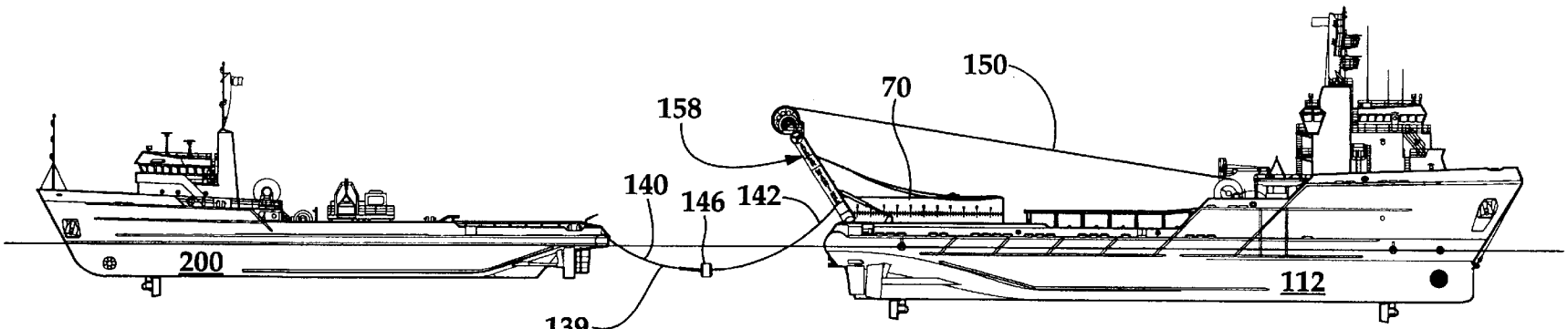
FIG. 14 is an illustration of an early stage in the installation of a suction anchor in accordance with the present invention.
Figure 15:
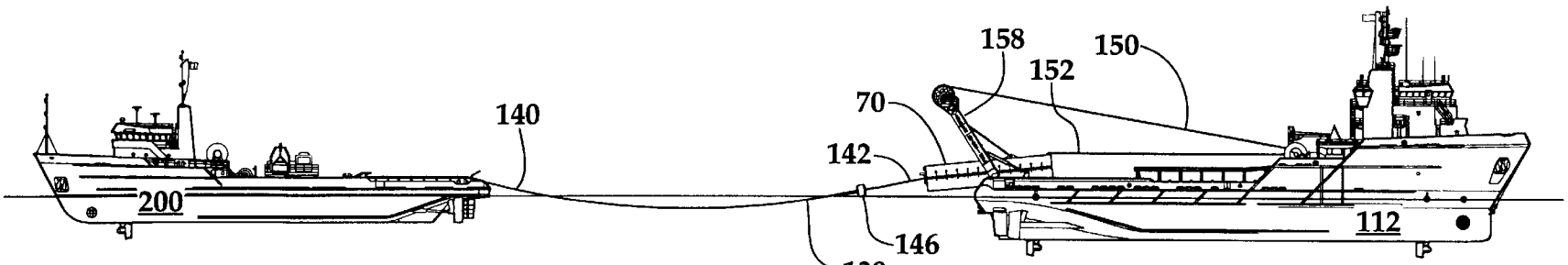
FIG. 15 is an illustration of a somewhat later stage in the installation of the suction anchor.
Figure 16:
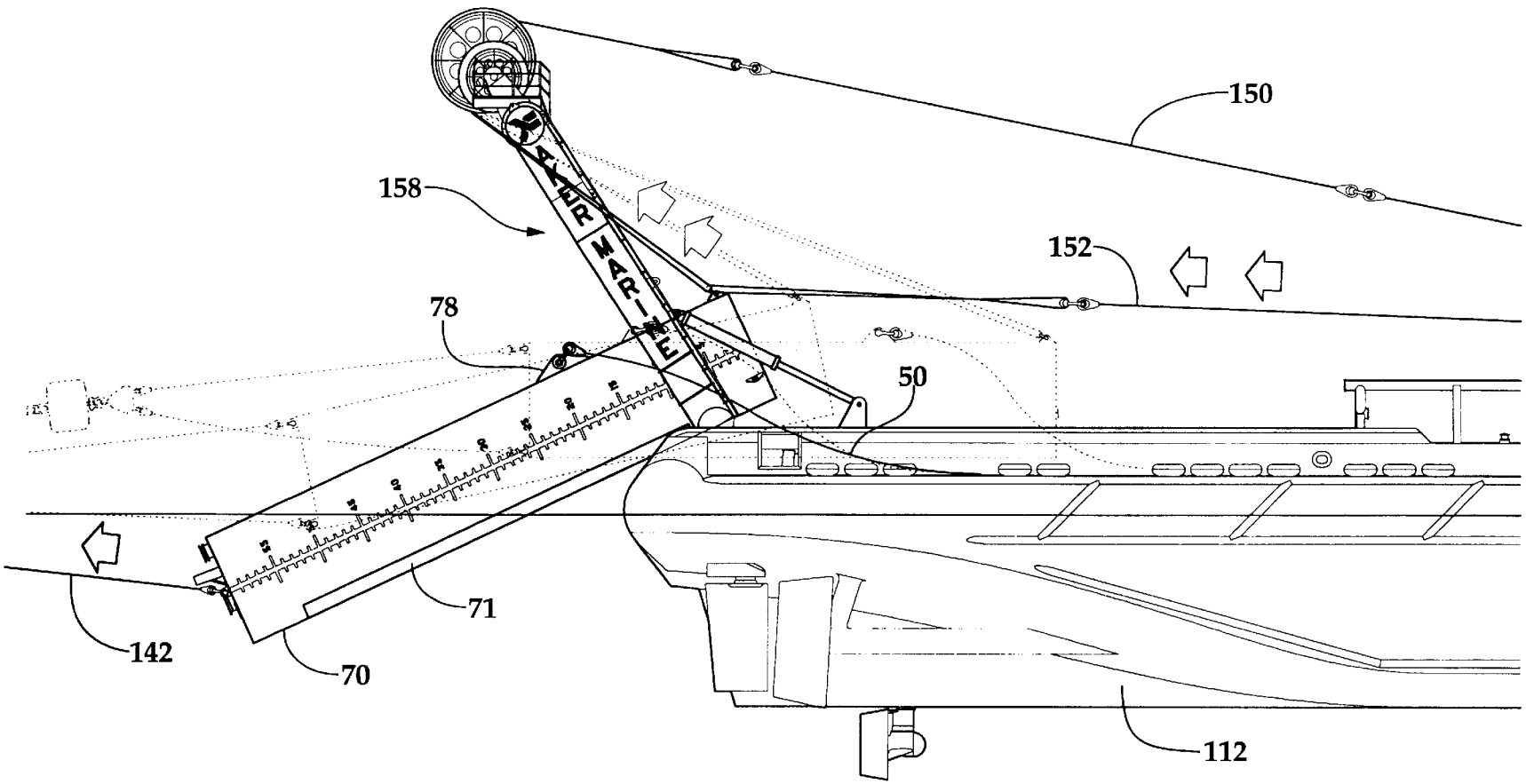
FIG. 16 is an illustration of a still later stage in the installation of the suction anchor.
Figure 17:
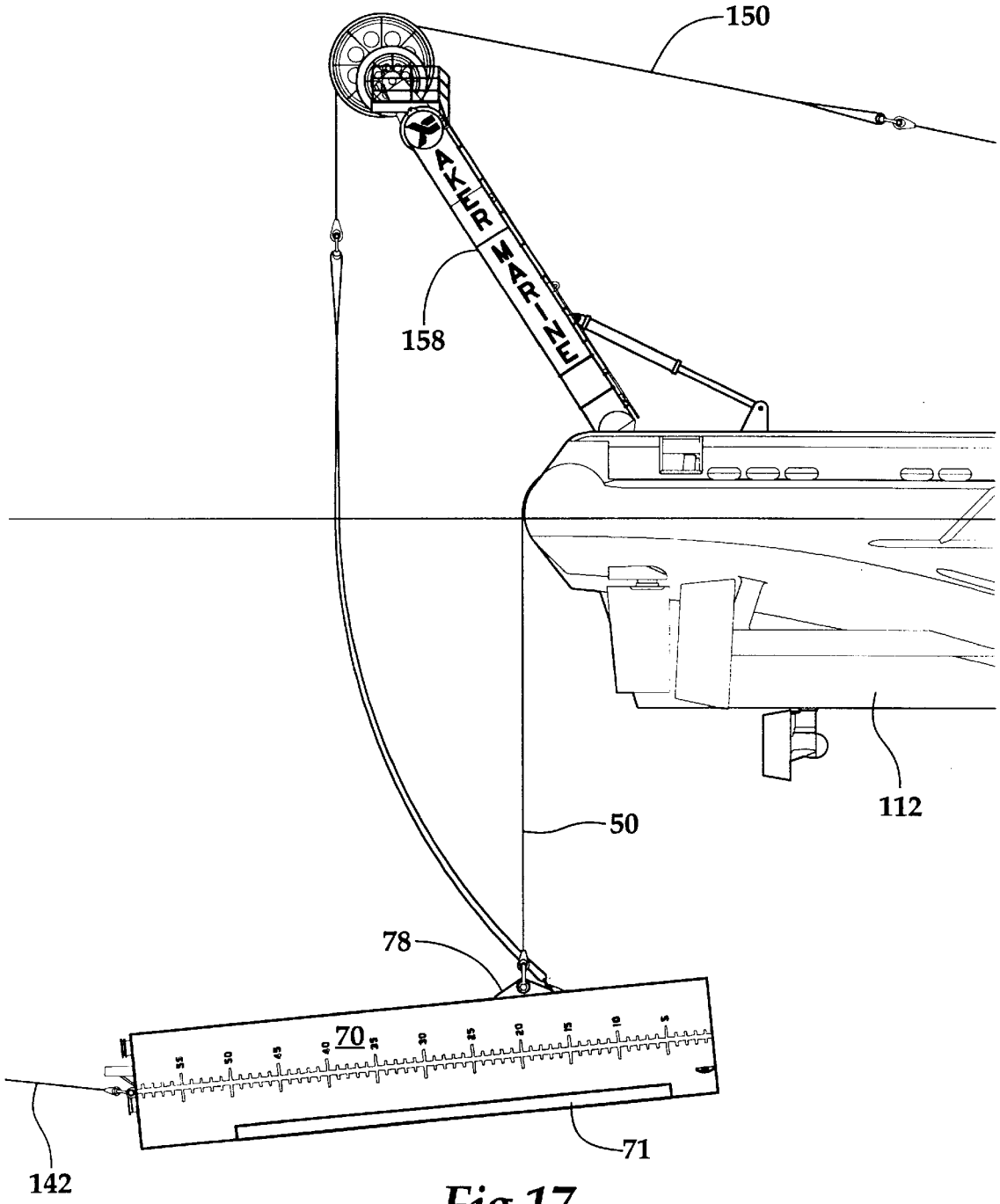
FIG. 17 is an illustration of a still later stage in is the installation of the suction anchor.
Figure 18:
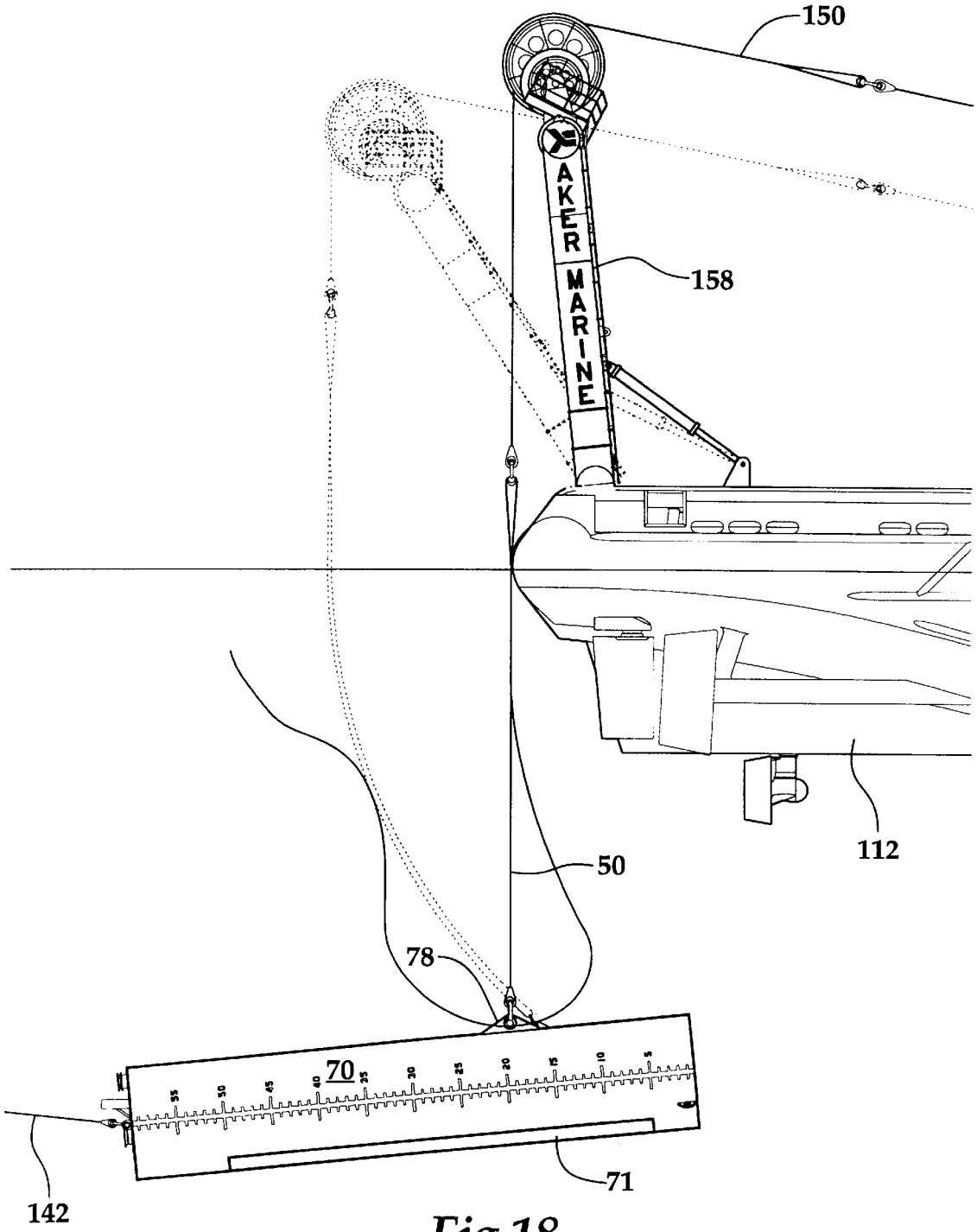
FIG. 18 is an illustration of a still later stage in the installation of the suction anchor.

Referring now to FIG. 14 therein is illustrated the initial deployment stage of the suction anchor 70. The installation vessel 110 is positioned at the drilling venue with its bow into the prevailing seas. Recovery pendent line 142 and a recovery buoy 146 are rigged to the top of the suction anchor 70 by connection to the pad eyes 87.

It is also possible to install and recover the suction anchor 70 without using the recovery buoy 146. In such instances there is provided a doubled sling secured to the top of the suction anchor 70 which is laid down across the suction anchor and onto the sea floor. For recovery of the suction anchor, the ROV 300 connects a special hook to the doubled sling. This option comprises an important feature of the invention since recovery buoys suitable for use in very deep water are expensive to purchase and maintain.

The recovery buoy 146, if used, is secured to a nylon stretcher 139 which is in turn secured to a multi-strand lowering wire 140 spooled off an auxiliary vessel 200. The nylon stretcher 139 allows the stern of the auxiliary vessel 200 to heave in the seas without overloading the lowering wire 140. An upper drum work wire 150 is rigged over an A-frame gantry 158 and connected to the suction anchor 70. A lower drum work wire 152 is also connected to the suction anchor for use as a hold back line.

Figure 19:
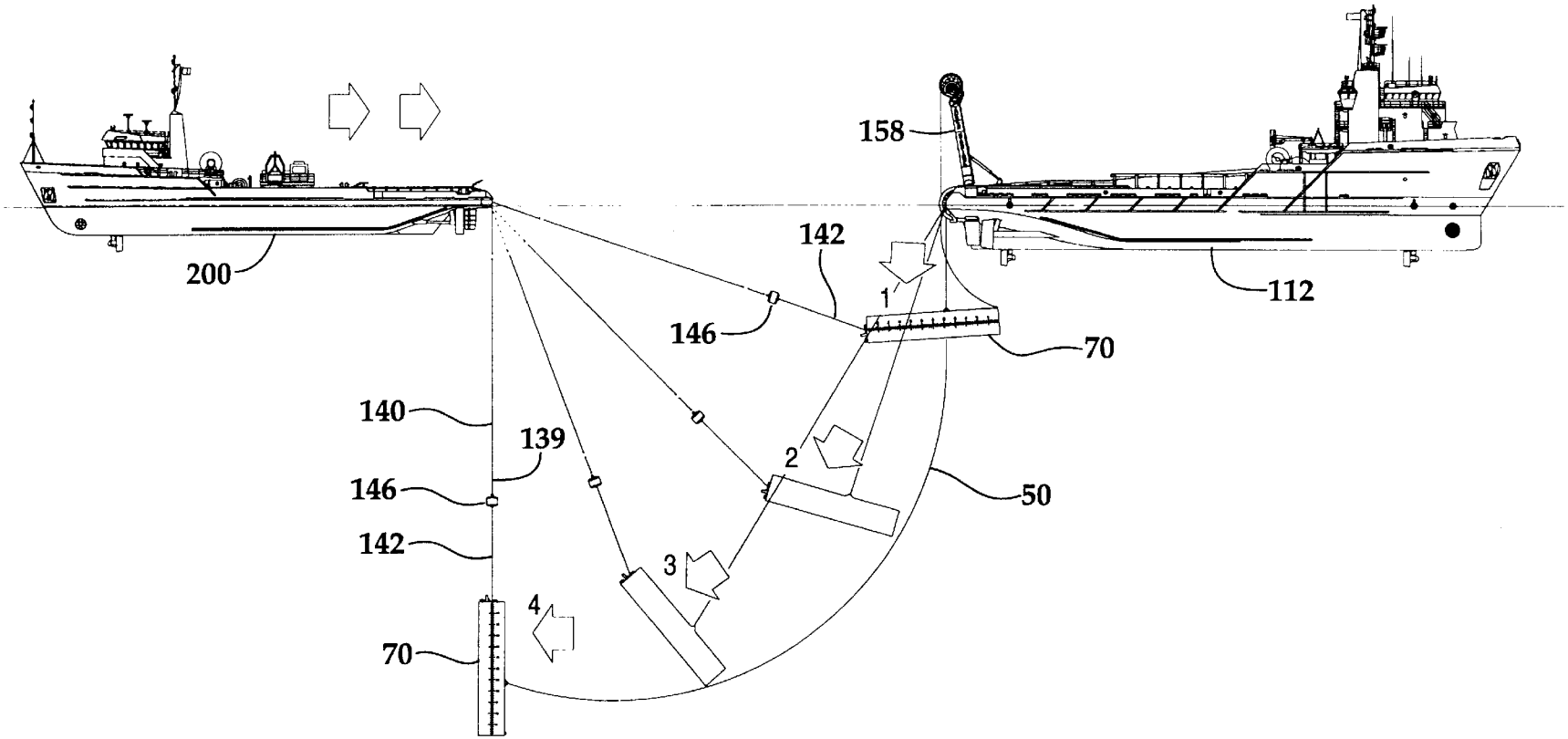
FIG. 19 is an illustration of a still later stage in the installation of the suction anchor.

Turning now to FIGS. 15 through 19, the auxiliary vessel 200 moves away from the installation vessel 100 paying out approximately 100 feet of the lowering wire 140. The auxiliary vessel 200 stops paying out lowering wire 140 and increases tension in the lowering wire. Slowly the lower drum work wire 152 allows the auxiliary vessel 200 to pull the suction anchor 70 out into the water. The A-frame gantry 158 is moved slowly aft, as required, payingout the riser wire 50. The upper drum work wire 150 lifts the lower end of the suction anchor 70 and the lower drum work wire 152 is disengaged. As shown in FIG. 19, the riser wire 50 is payed out while the auxiliary vessel 200 moves closer to the installation vessel 110. The upper drum work wire 150 is disengaged, the suction anchor 70 swings down under the stern of the auxiliary vessel 200 and the weight of the suction anchor 70 is transferred to the lowering wire 140.

Figure 20:
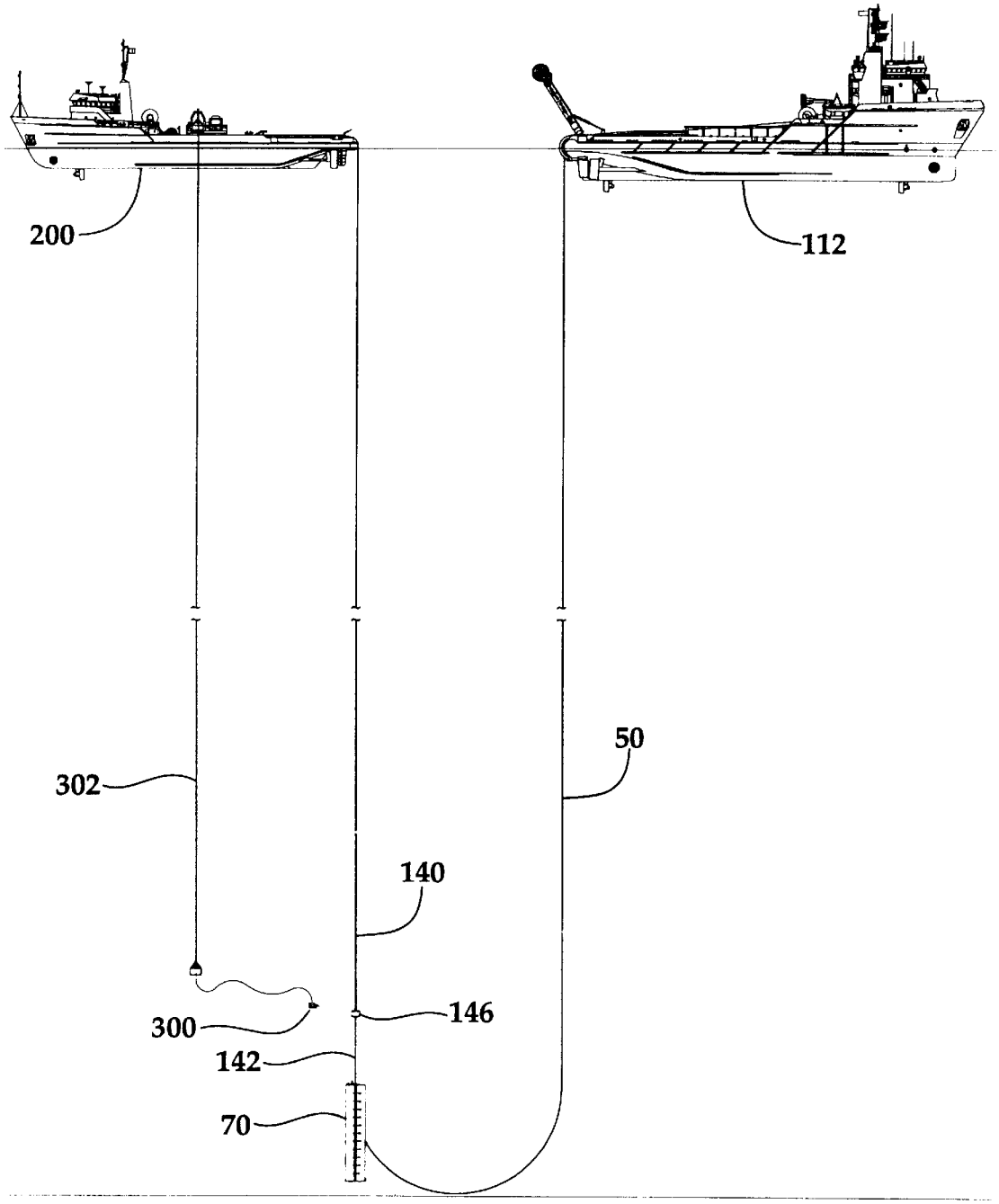
FIG. 20 is an illustration of a still later stage in the installation of the suction anchor.

Turning now to FIG. 20, a remote operation vehicle (ROV) 300 is deployed from the auxiliary vessel 200. ROV 300 may comprise a Raycal SEA Lion MK II heavy work class ROV having 100 horsepower; however, any of the various commercially available ROV's having 75 h.p. or more can be used in the practice of the invention. The lowering wire 140 and riser wire 50 are paid out until the suction anchor reaches the ocean floor. Meanwhile the auxiliary vessel also pays out the ROV's umbilical wire 302, so that the ROV can observe the suction anchor during its descent.

Figure 21:
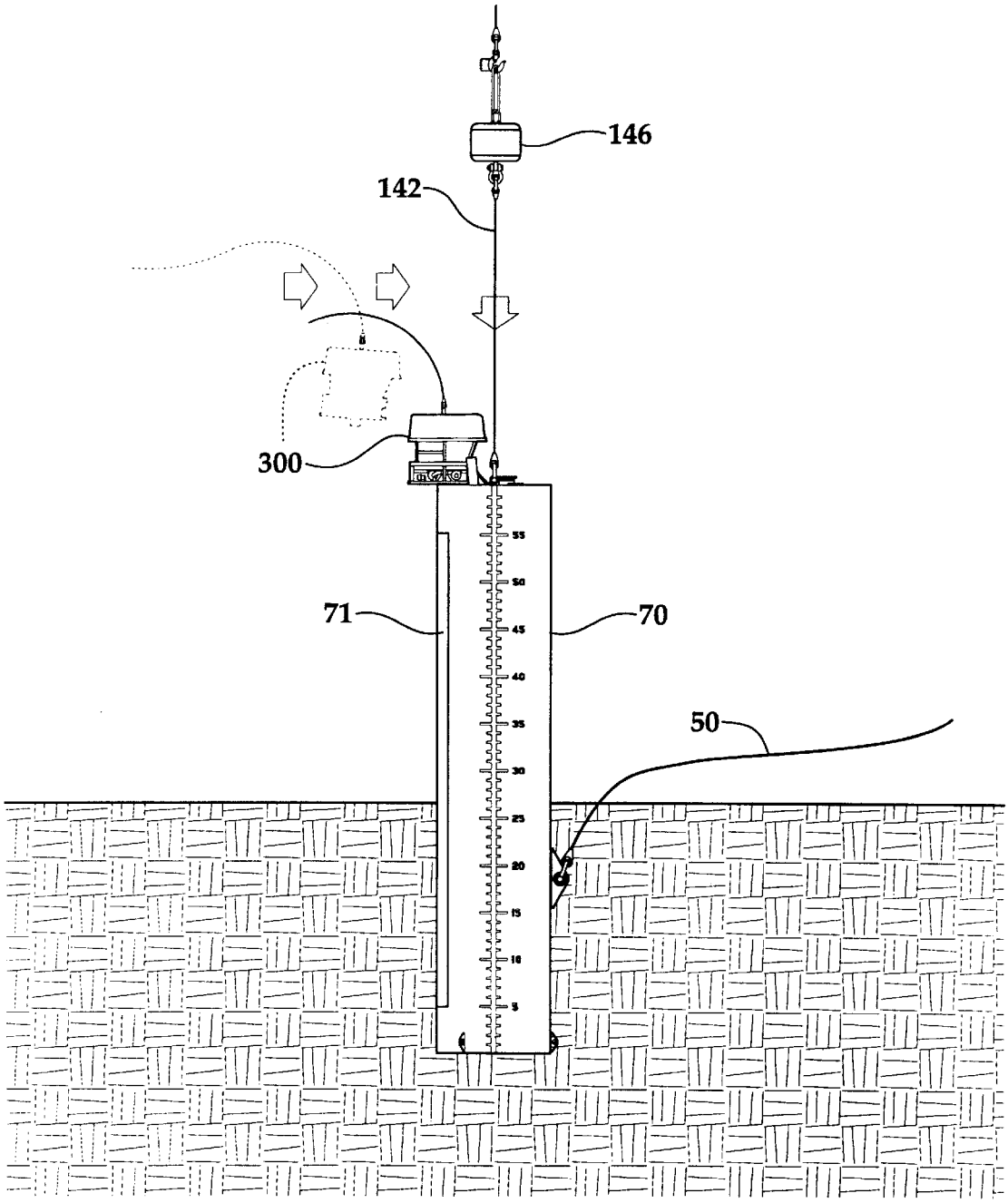
FIG. 21 is an illustration of a still later stage in the installation of the suction anchor.

As shown in FIG. 21, the suction anchor 70 is slowly lowered into the seafloor under its own weight. Meanwhile the ROV 300 observes the bullseye level 85 on the top of the suction anchor 70 to assure that the suction anchor remains vertical within established tolerances. Under its own weight, the suction anchor 70 will penetrate about 40%–50% of its length into the seafloor (typical in the-Gulf of Mexico). The ROV 300 next checks the amount of self penetration by reading the penetration marks at the mudline, while the lowering line 140 is slacked off. During the lowering process the evacuation ports 82 and suction port 88 remain open, allowing water displaced by the ocean floor inside the suction anchor to flow outwardly through these ports.

Figure 22:
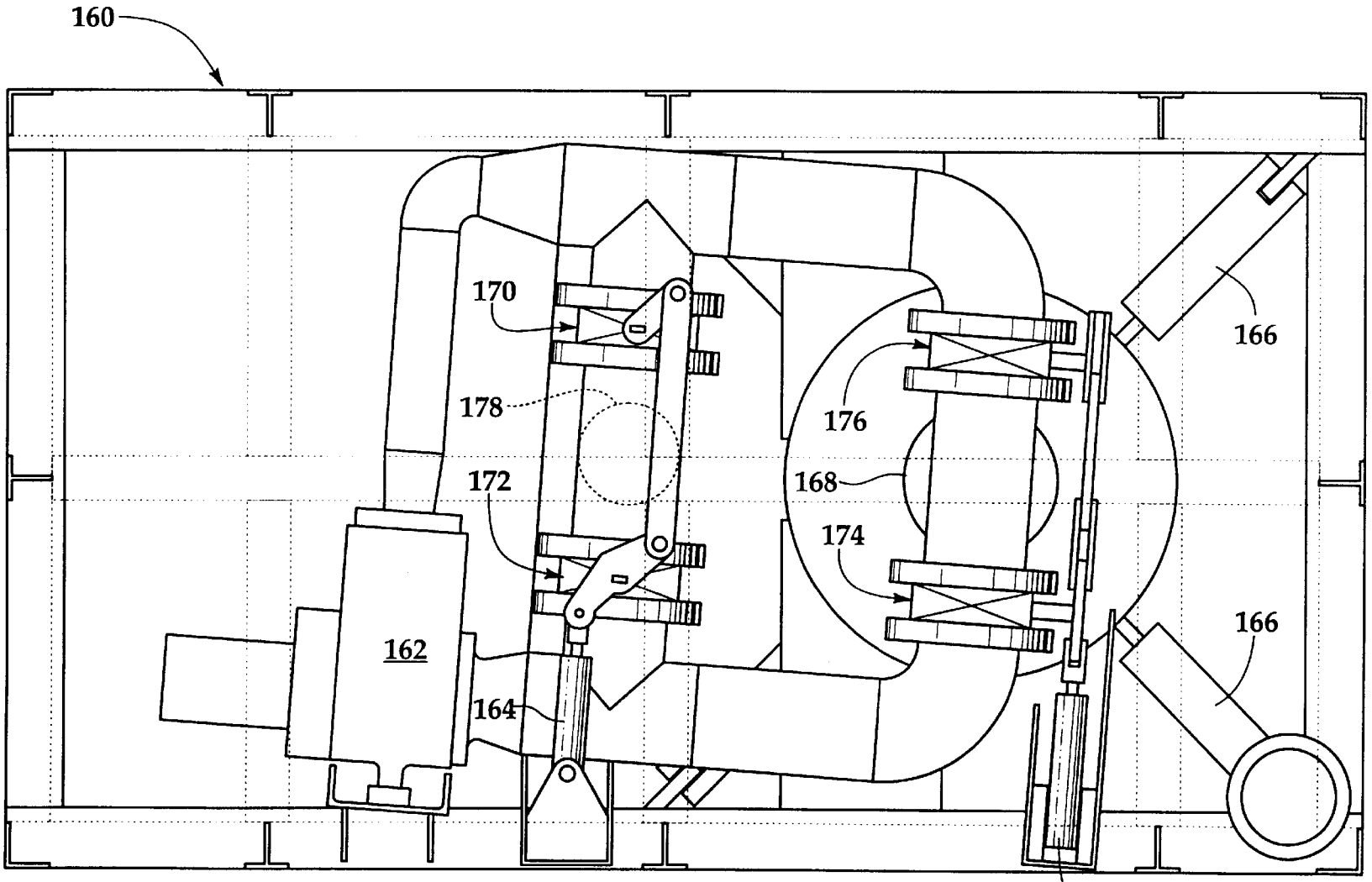
FIG. 22 is a top view of a pumpskid useful in the practice of the invention.
Figure 23:
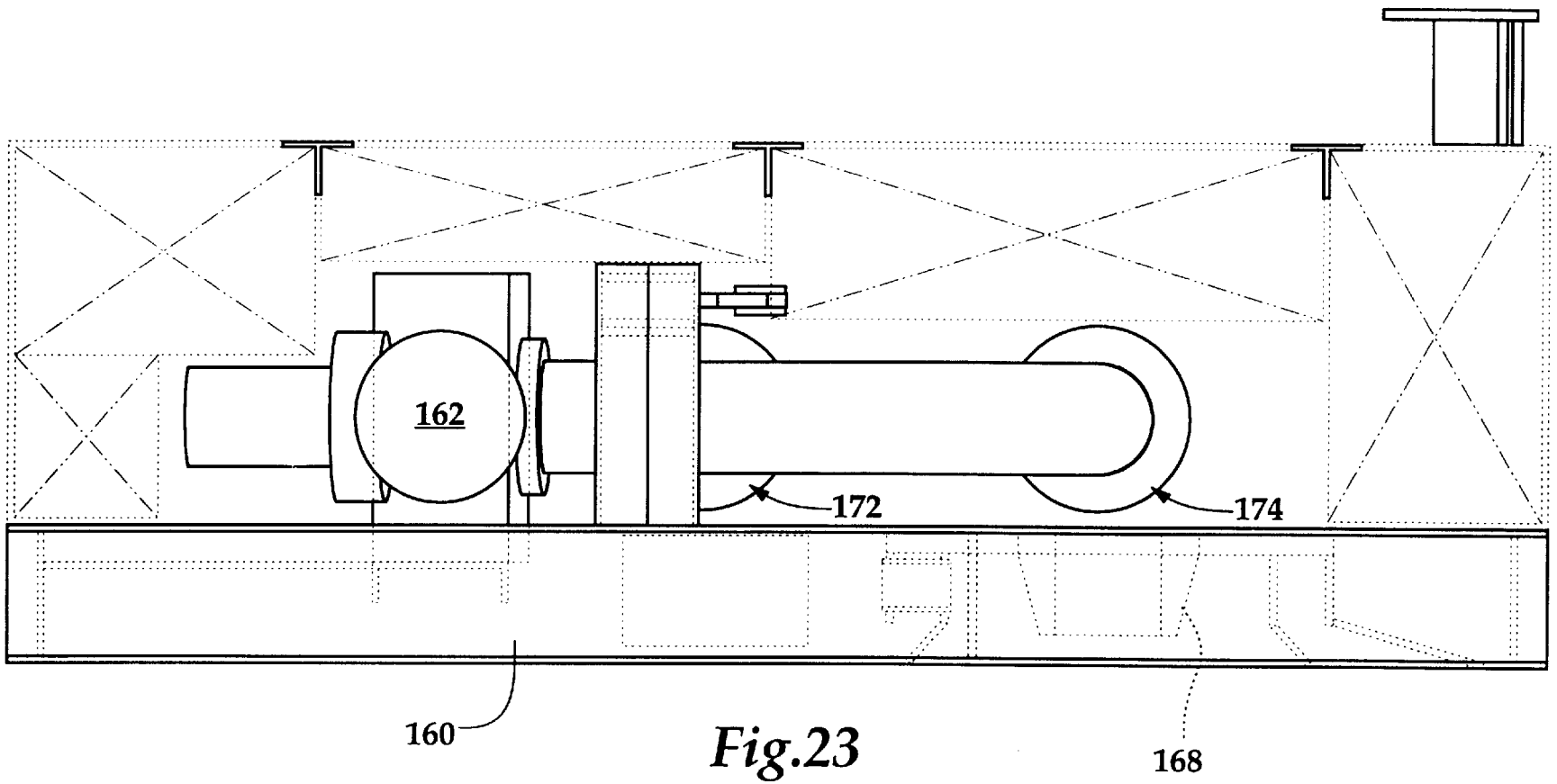
FIG. 23 is a side view of the pumpskid of FIG. 22.
Figure 24:
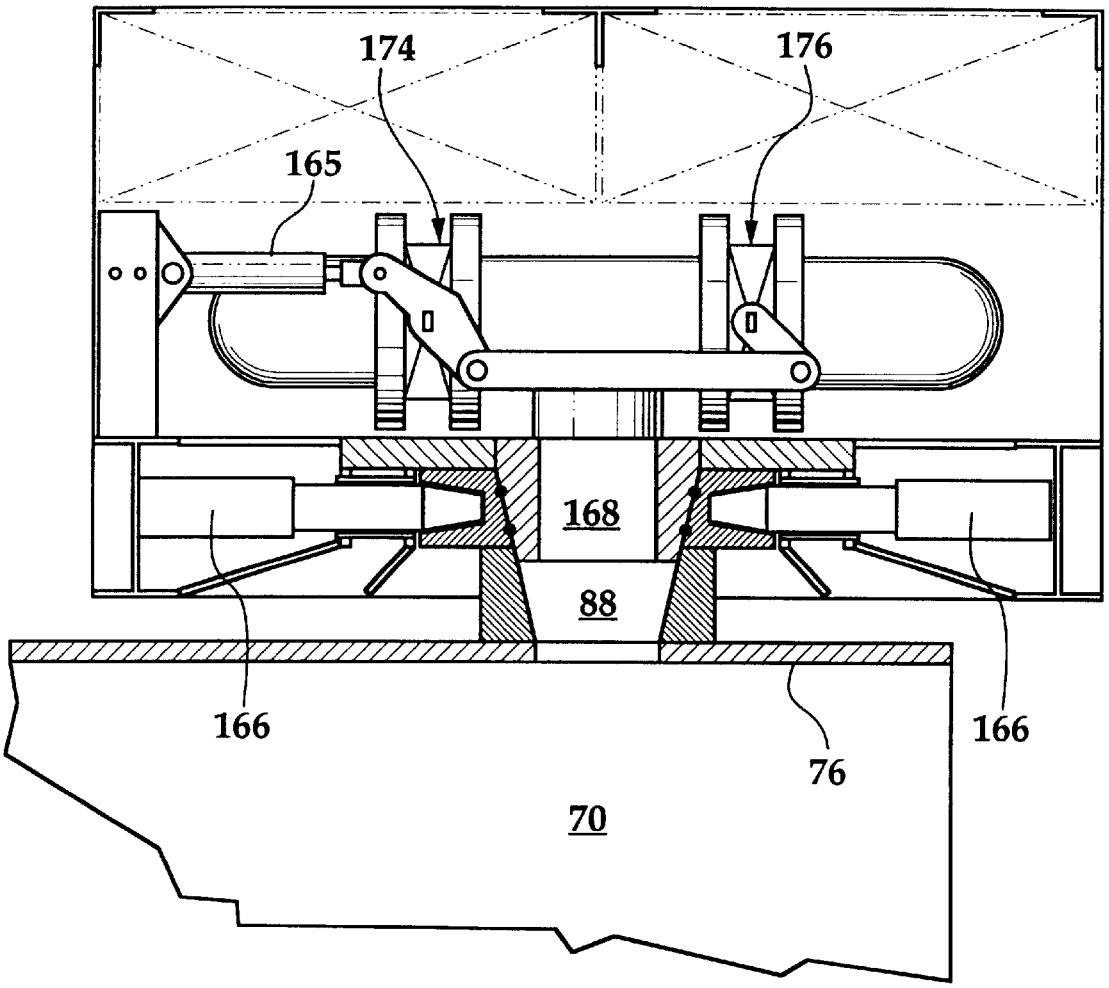
FIG. 24 is an end view of the pumpskid of FIG. 22.

As shown in FIGS. 22, 23, and 24, the ROV 300 is fitted with a pumpskid 160 which is mounted beneath the ROV. The pumpskid 160 includes a pump 162, pump manifold valve actuators 164 and 165, and latching actuators 166, all powered and controlled by the hydraulic system of the ROV 300. The pumpskid further includes a male connector 168 for the suction port 88.

Next, the ROV 300 docks and latches onto the suction anchor and its suction port 88 by engagement of the male connector 168 and by engaging the latching actuators onto the clamp down hub of the suction port 88. Next, the ROV closes the ports 82. The pump 162 of the pumpskid 160 is started and pumps water out of the interior of the suction anchor 70, reducing the water pressure inside relative to the outside pressure. This is accomplished by means of actuator 164 which opens valve 170 and closes valve 172 and actuator 165 which opens valve 174 and closes valve 176, thereby causing water to flow through suction port 88, valve 174, pump 162, and valve 170, and then out-through opening 178.

Figure 25:
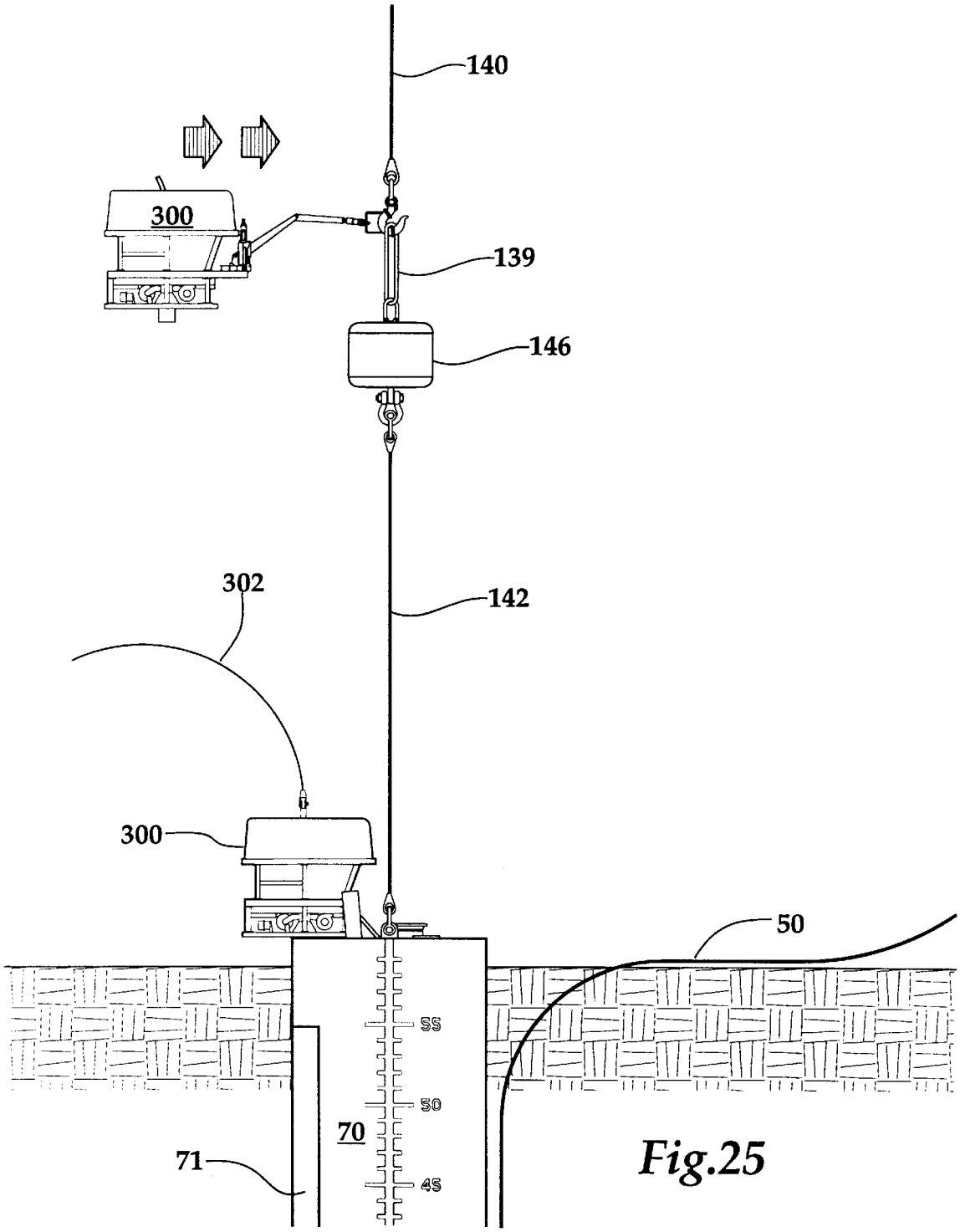
FIG. 25 is an illustration of the final stages in the installation of the suction anchor.

The differential pressure under the action of pump 162 acts as a downwards force on the top of the suction anchor 70 pushing the suction anchor further into the seafloor to the desired penetration depth. When the desired penetration has been reached, as determined from the ROV's depth monitoring system, the ROV disconnects from the top of the suction anchor 70. Next the ROV checks the suction anchor penetration by reading the penetration marks at the mudline. When the suction anchor 70 penetration is found to be within tolerance, the ROV 300 closes the suction port 88 so that all openings in the top of the suction anchor are closed. As is shown in FIG. 25, the ROV 300 now disconnects lowering line 140 from the recovery buoy 146. Next the ROV is retrieved by the auxiliary vessel 200.

Figure 26:
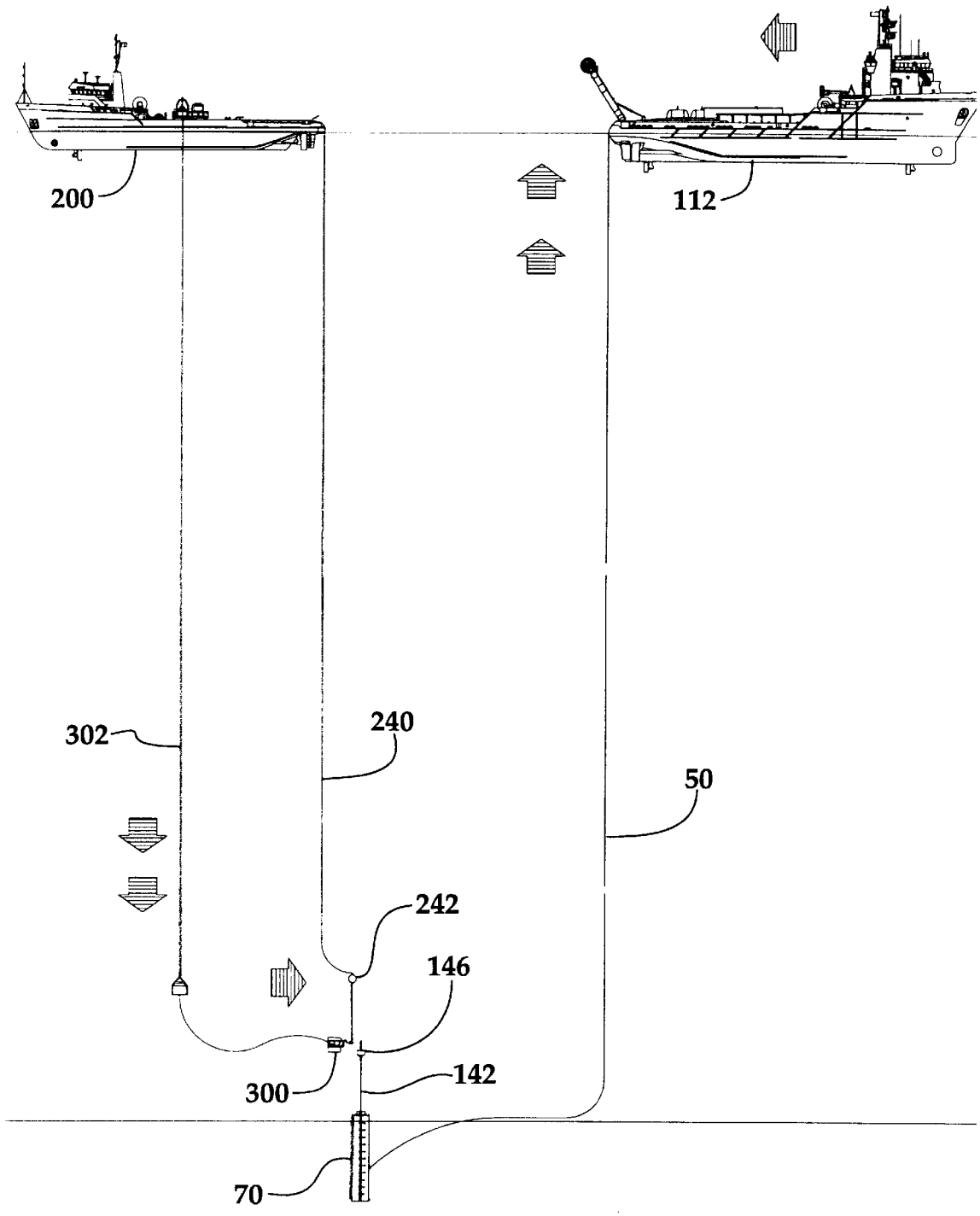
FIG. 26 is an illustration of an early stage in the removal of the suction anchor in accordance with the present invention.
Figure 27:
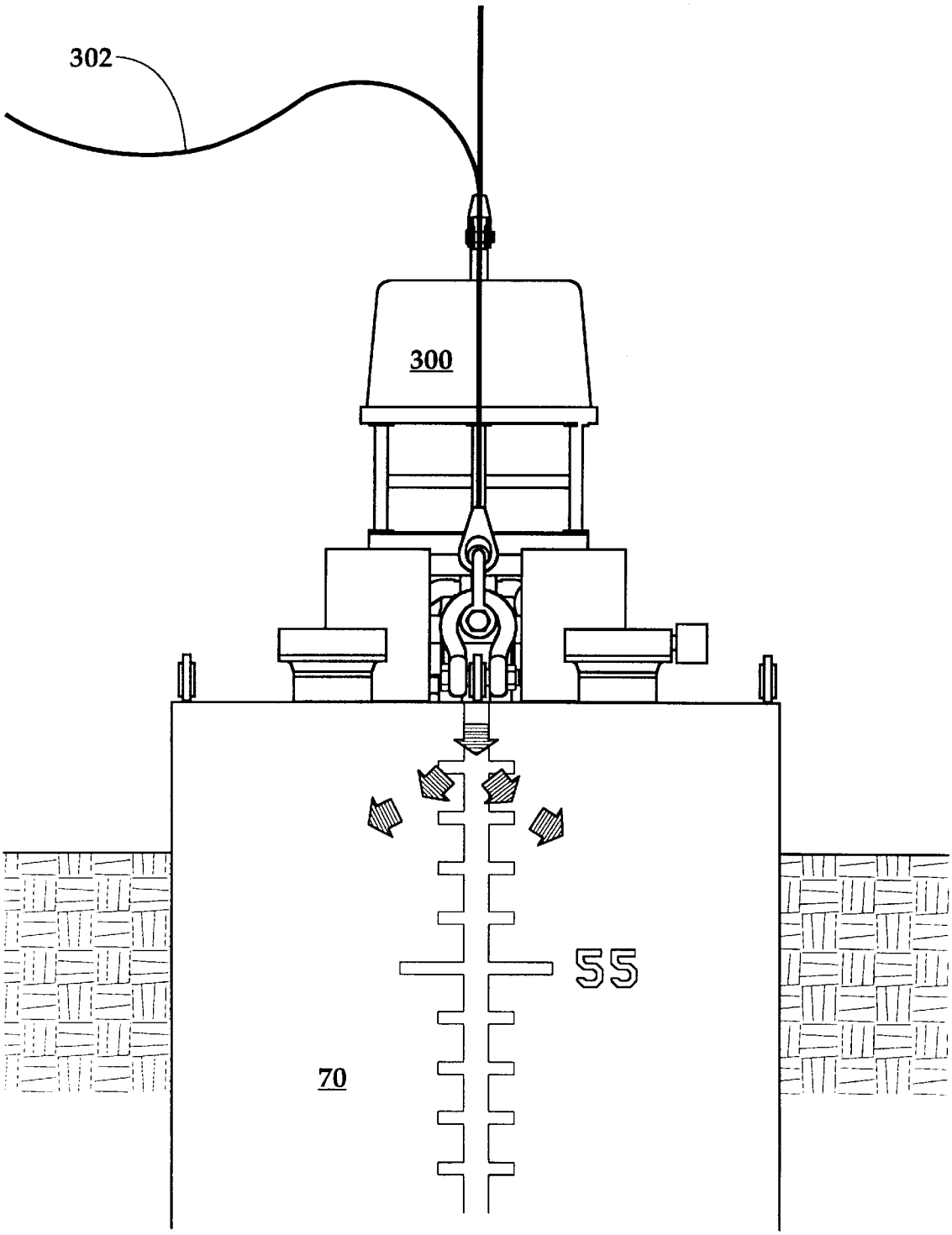
FIG. 27 is an illustration of a later stage in the removal of the suction anchor.
Figure 28:
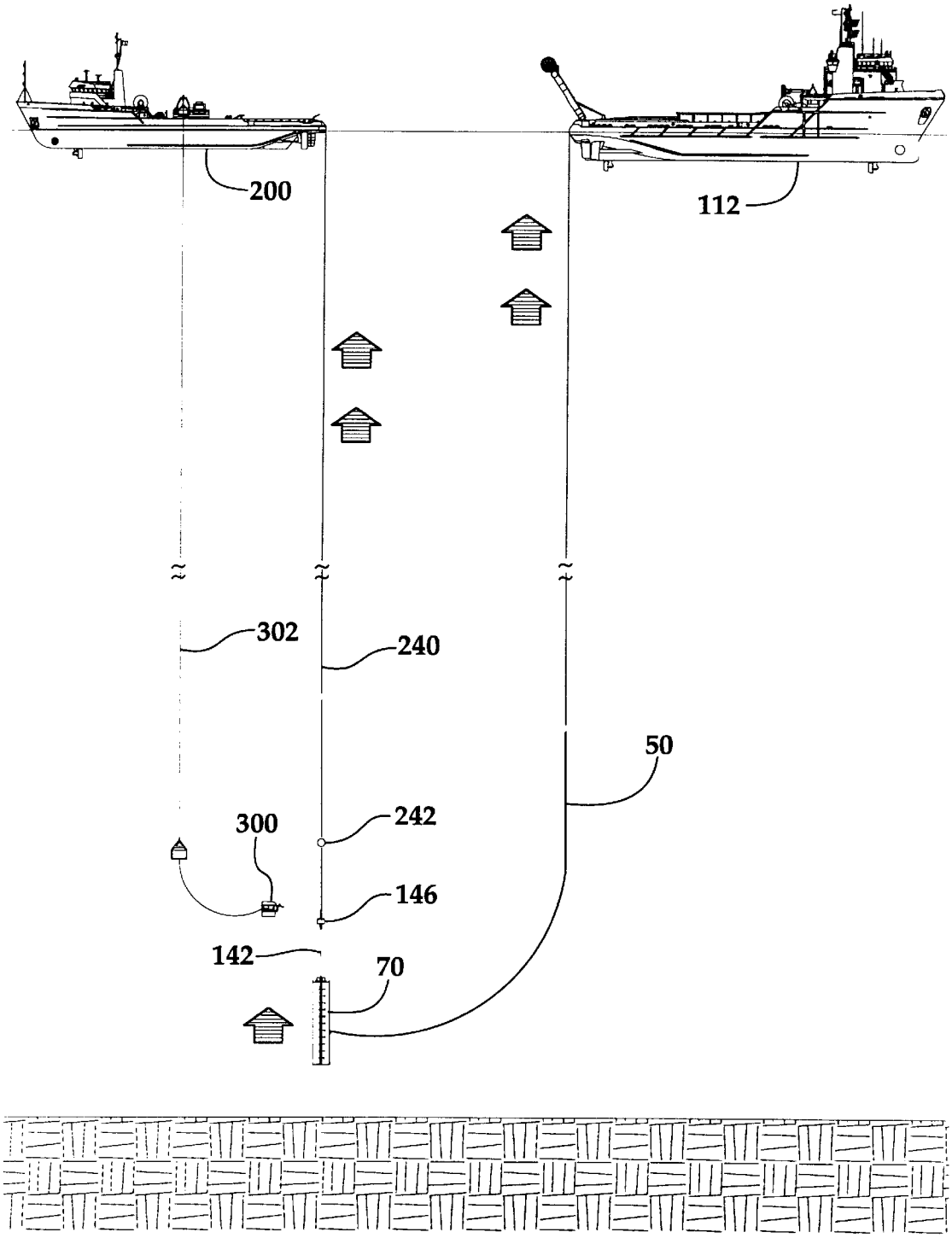
FIG. 28 is an illustration of a still later stage in the removal of the suction anchor.

Turning now to FIG. 26, 27, and 28, therein is illustrated a recovery procedure that may be employed to recover the suction anchor 70 after drilling operations at a particular drilling venue are completed. The installation vessel 112 is attached by the riser wire 50 to the suction anchor 20. The auxiliary vessel 200 lowers the ROV 300 with the pumpskid 160 on the umbilical wire 302, while at the same time the recovery wire 240 is lowered to the seafloor. The recovery wire 240 is equipped with a special hook, and a submerged buoy 242 some distance above the hook. The submerged buoy 242 isolates the hook from much of the auxiliary vessel's heave motions. The ROV 300 attaches the hook to the doubled sling on the recovery buoy, or to the doubled sling laying across the suction anchor. The auxiliary vessel takes up tension on the recovery line 240, and the ROV 300 docks onto the suction anchor top and latches onto the suction port 88. The ROV 300 pumps water into the interior of the suction anchor by means of the pump 162. This is accomplished by operating the actuators 164 and 165 to open valve 176, open valve 172, close valve 174, and close valve 170, thereby causing water to flow through opening 178, valve 172, pump 162, valve 176 and port 88 into anchor 70.

Due to the pump 162, the water pressure inside becomes greater than the outside water pressure, and the differential pressure results in an upwards force on the suction anchor top. The upwards force, and the pull on the recovery line pulls the suction anchor out of the seafloor. If too much pump pressure is required to pull the suction anchor 70 out of the seafloor, due to too much consolidation of the soil around and inside the suction anchor, the water flow direction of the pump 162 can be reversed instantaneously by changing the positions of valve actuators 164 and 165. By rapidly changing the water flow direction from pumping in to pumping out, the suction anchor 70 will be alternately pulled out and pushed in. When this is done over time, the soil in contact with the suction anchor cylinder will liquefy, making it easier to pump and pull the suction anchor out off the soil. The suction anchor 70 is raised to the surface by recovery line 240 and is loaded on installation vessel 112 using the riser line 50.

Figure 29:
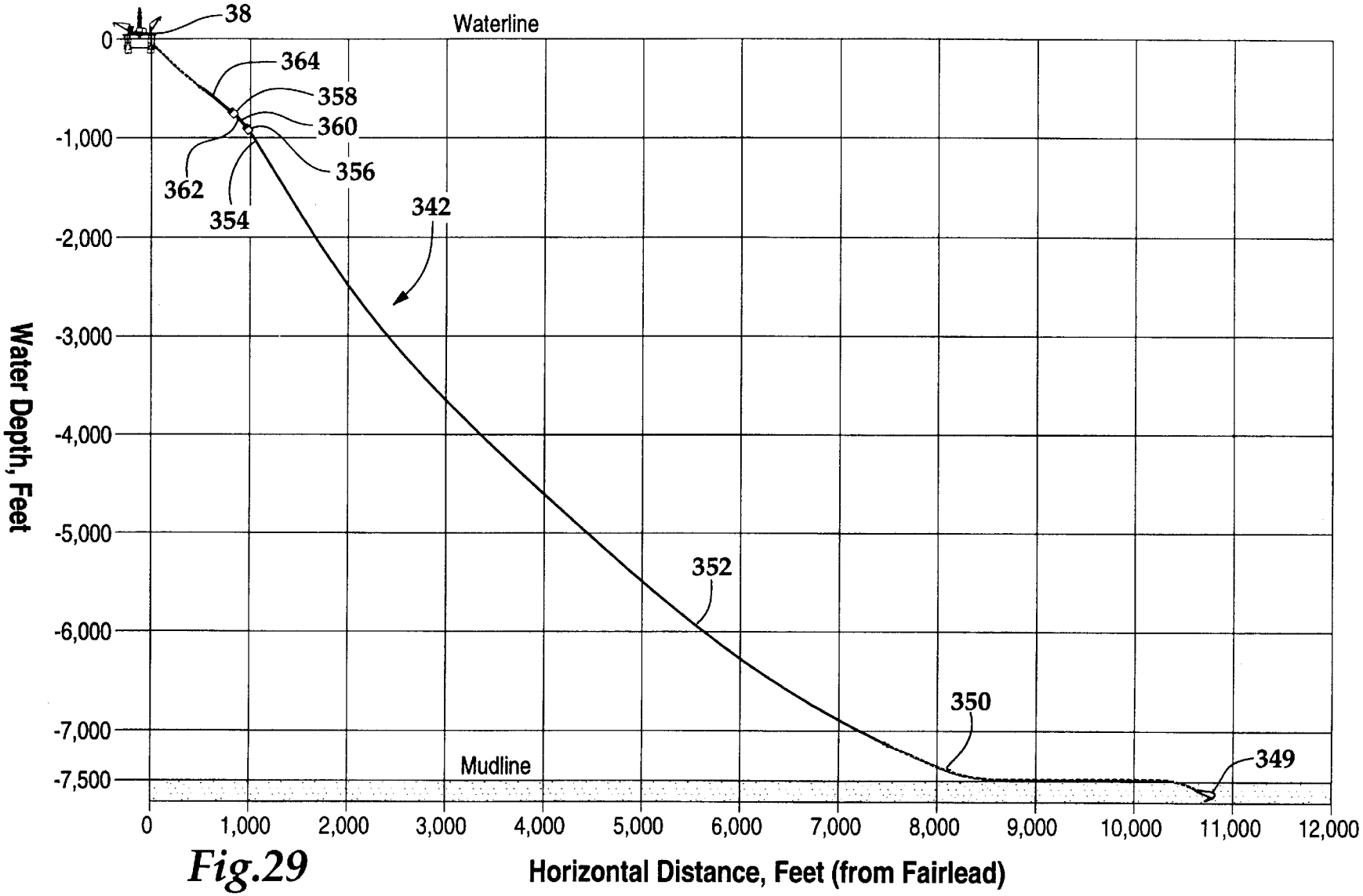
FIG. 29 is an illustration of a recoverable system for mooring offshore drilling units comprising a second embodiment of the invention.
Figure 34:
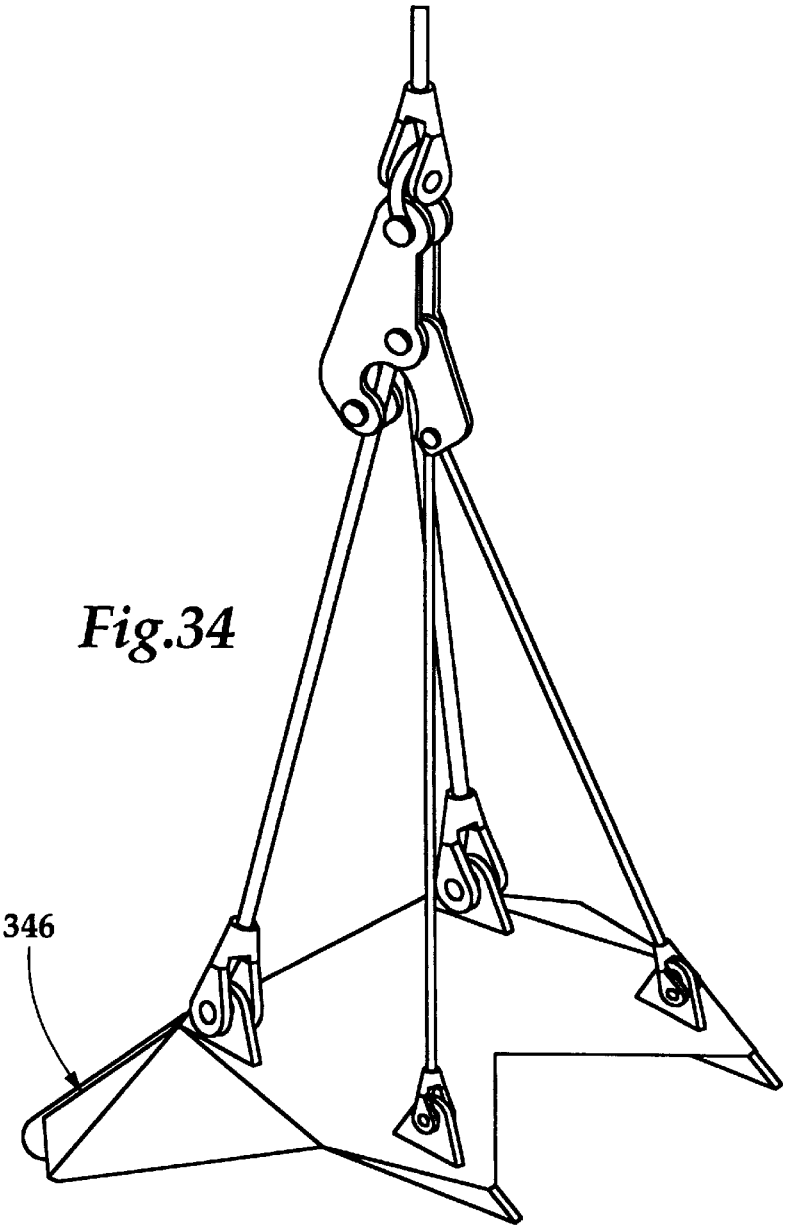
FIG. 34 is an illustration of a first type of vertically loaded anchor useful in the practice of the invention.
Figure 35:
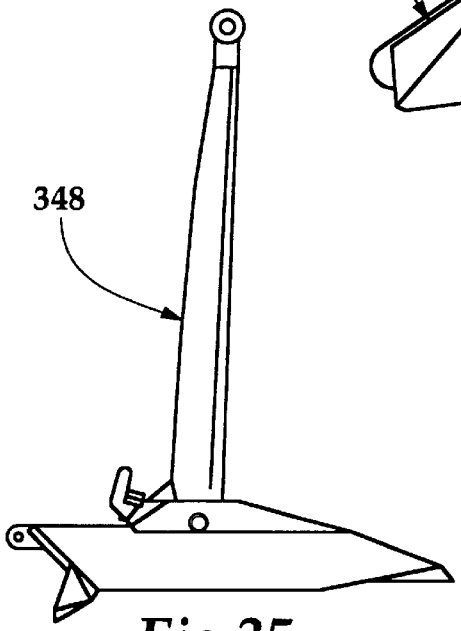
FIG. 35 is an illustration of a second type of vertically loaded anchor useful in the practice of the invention.
Figure 36:
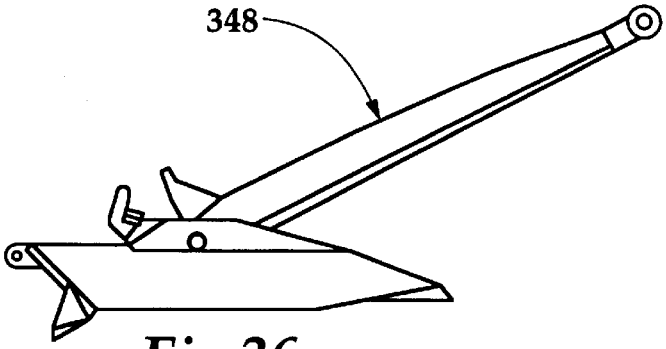
FIG. 36 is an illustration of the vertically loaded anchor of FIG. 35 showing the anchor in the installed configuration.

Referring now to FIG. 29, there is shown a catenary mooring leg 342 which may be used in the practice of the invention in lieu of the taut-leg mooring leg 42 illustrated in FIGS. 2 and 3 and described hereinabove in conjunction therewith. The mooring leg 342 may employ a suction anchor of the type illustrated in FIGS. 4, 5, 6, 7, and described hereinabove in conjunction therewith. Alternatively, the mooring leg 342 may employ a vertically loaded anchor. Referring momentarily to FIGS. 34, 35, and 36, the vertically loaded anchor may comprise a vertically loaded anchor 346 of the type sold by Vryhof under the trademark "STEVMANTA". Alternatively, the vertically loaded anchor may comprise a vertically loaded anchor 348 of the type sold by Bruce under the trademark "DENIA". Vertically loaded anchors are particularly adapted to the practice of the present invention for two reasons. First, vertically loaded anchors are designed and adapted to accommodate and withstand relatively high vertical loads and are therefore particularly adapted for use in conjunction with taut-leg mooring legs. Second, vertically loaded anchors are designed and adapted to be recovered after the project for which they are installed has been completed.

Referring again to FIG. 29, the mooring leg 342 employs a drag embedment anchor 349. A 3-inch diameter, 3,300-foot long ORQ ground chain 350 is connected to and extends from the anchor 349. A 3¼-inch diameter, 9,000-foot long IWRC–EIPS+20% catenary wire 352 is connected to the distal end of the chain 350 and extends upwardly therefrom. A 3-inch diameter, 15-foot long ORQ+20% buoy chain pendant 354 is connected to the distal end of the catenary wire 352. The 64-foot kip fixed buoyancy submerged buoy 356 is connected to the buoy pendant chain 354. The buoy 356 is similar to the buoy 54 illustrated in FIGS. 9, 10, and 11, and described hereinabove in conjunction therewith except that the buoy 356 comprises a single block of syntactic foam similar to the block 104 of the buoy 54 and does not include removable syntactic foam sections such as the foam sections 106 of the buoy 54.

The buoy 356 is utilized in conjunction with a 57-kip adjustable buoyancy submerged buoy 358 which is identical in construction and function to the buoy 54 illustrated in FIGS. 9, 10, and 11.

A 3¼-inch diameter, 200-foot long IWRC–EIPS+20% intermediate connection pendant 360 is connected to the upper end of the buoy 356. A 3-inch diameter, 15-foot long ORQ+20% buoy chain pendant 362 is connected to the distal end of the connection pendant 360. A 3¼-inch diameter, 400-foot long IWRC–EIPS+20% upper connection pendant 364 is connected to the upper end of the buoy 358. The upper connection pendant 364 is connected to a 3-inch diameter, 700-foot long ORQ rig chain which extends from the MODU 38. As will be appreciated by those skilled in the art, the taut-leg mooring leg 342 is typically not employed singly but rather in combination with other, similar taut-leg mooring legs in order to properly stabilize the MODU at a drilling venue.

Figure 30:
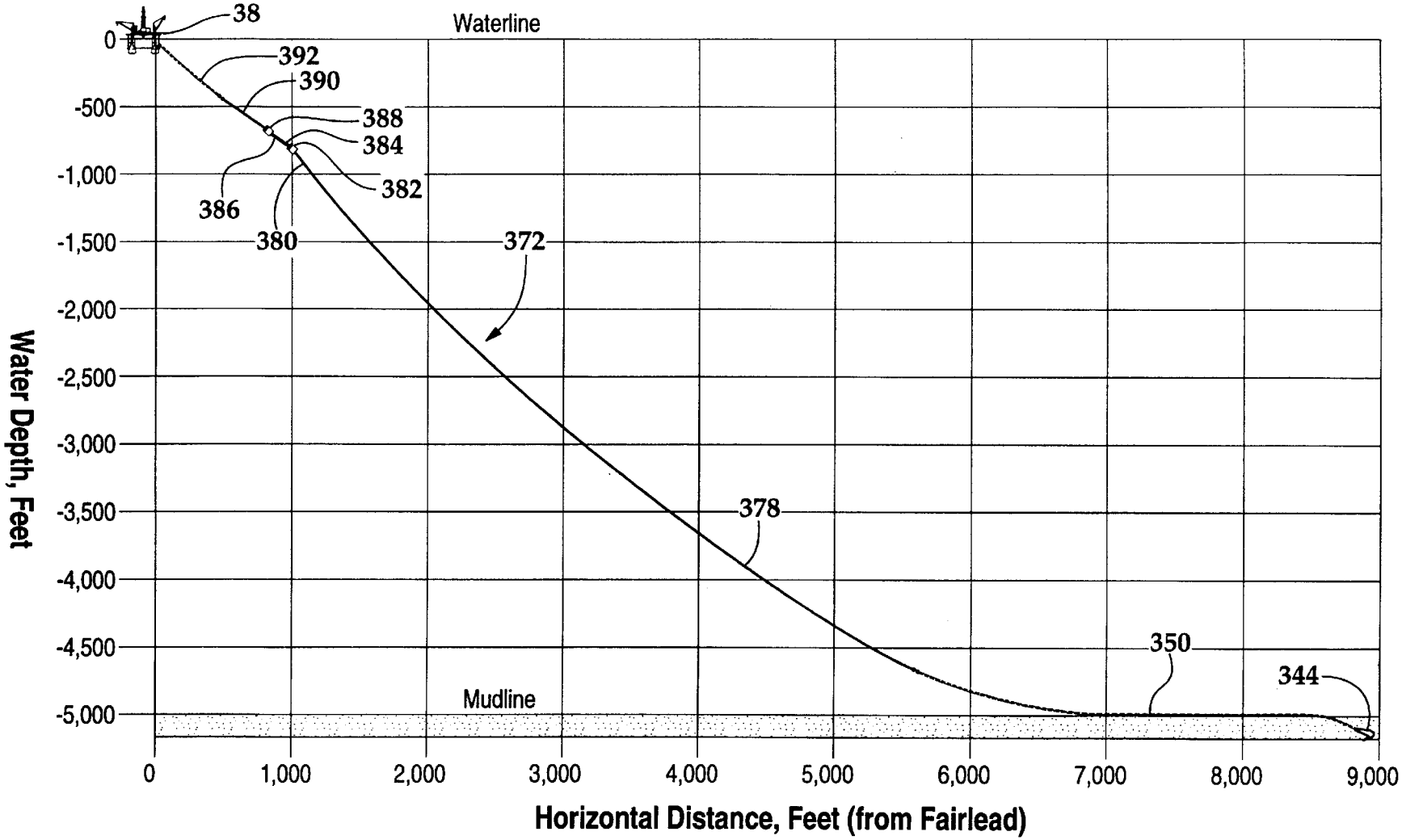
FIG. 30 is an illustration of a recoverable system for mooring mobile offshore drilling units comprising a third embodiment of the invention.

Referring now to FIG. 30, there is shown a catenary mooring leg 372 which may be utilized in the practice of the invention in lieu of the taut-leg mooring leg 42 illustrated in FIGS. 2 and 3 and described hereinabove in conjunction therewith. The mooring leg 372 may employ a suction anchor of the type illustrated in FIGS. 4, 5, 6, 7, and 8 and described hereinabove in conjunction therewith. Alternatively, the mooring leg 372 may employ a vertically loaded anchor comprising one of the two types of vertically loaded anchors illustrated in FIGS. 34, 35, and 36 and described hereinabove in conjunction therewith. As shown, the mooring leg 372 uses a drag embedment anchor 374.

A 3-inch diameter, 3,300-foot long ORQ ground chain 376 is connected to the vertically loaded anchor 374 and extends therefrom. A 3¼-inch, 6,000-foot long IWRC-EIPS+20% catenary wire 378 extends from the distal end of the ground chain 376. A 3-inch diameter, 15-foot long ORQ+20% buoy chain pendant 380 is connected between the distal end of the catenary wire 378 and a 64-kip fixed buoyancy submerged buoy 382. The buoy 382 is identical in construction and function to the buoy 360 illustrated in FIG. 29 and described hereinabove in conjunction therewith.

A 3¼-inch diameter, 200-foot long IWRC–EIPS+20% intermediate connection pendant 384 is connected to the upper end of the buoy 382. A 3-inch diameter, 15-foot long ORQ+20% buoy pendant chain 386 is connected between the distal end of the intermediate connection pendant 384 and a 17-kip adjustable buoyancy submerged buoy 388. A 3¼-inch diameter, 400-foot long IWRC–EIPS+20% upper connection pendant 390 is connected to the upper end of the buoy 388. The pendant 390 is in turn connected to a 3-inch diameter, 647-foot long ORQ rig chain 392 extending to and connecting from the MODU 38. Those skilled in the art will appreciate the fact that the mooring leg 372 is typically not employed singly, but rather is employed in conjunction with other, similar mooring legs in order to properly stabilize the MODU at a drilling venue.

Figure 31:
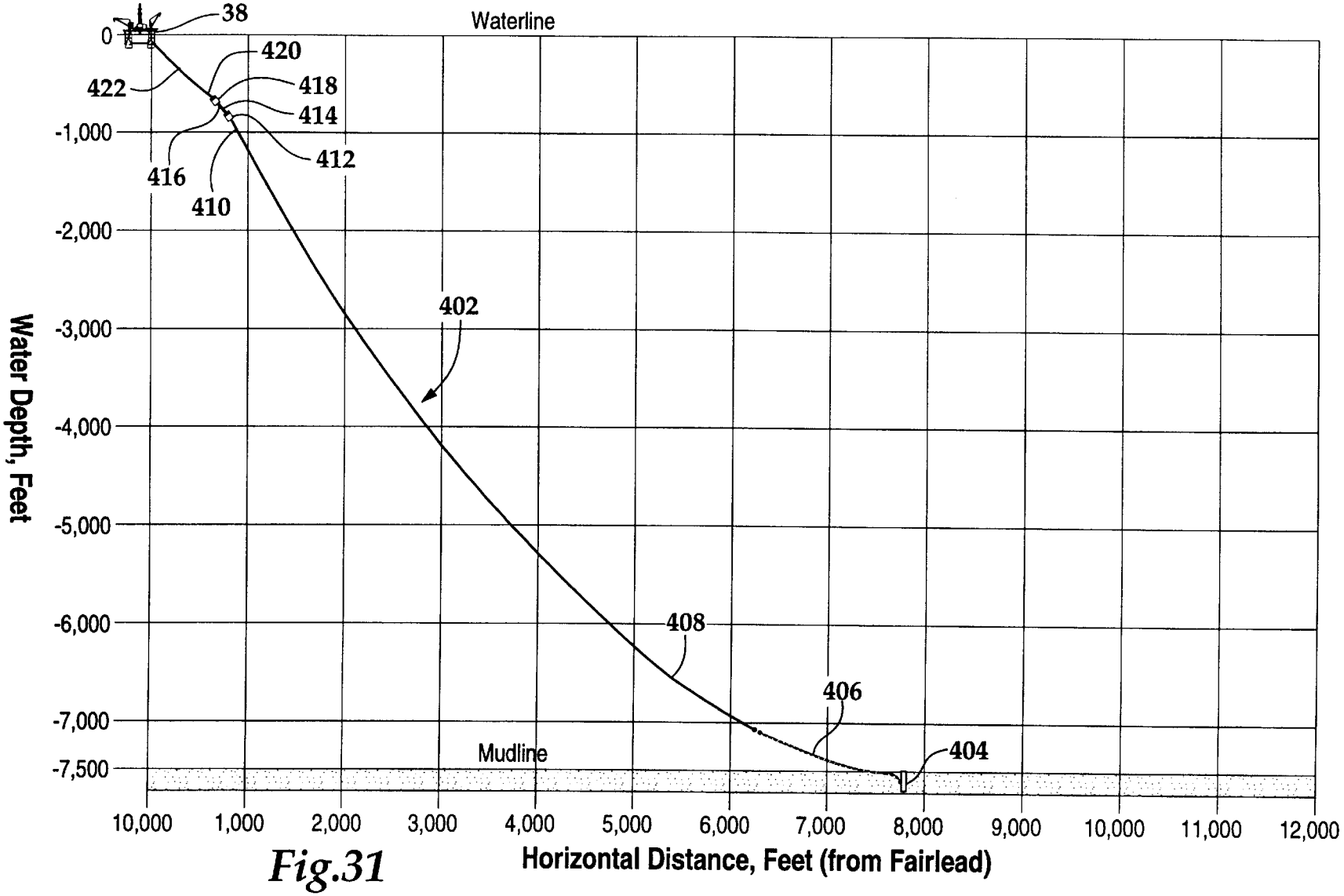
FIG. 31 is an illustration of a recoverable system for mooring offshore drilling units comprising a fourth embodiment of the invention.

Referring now to FIG. 31, there is shown a taut-leg mooring leg 402 which may be utilized in the practice of the invention in lieu of the taut-leg mooring leg 42 illustrated in FIGS. 2 and 3 and described hereinabove in conjunction therewith. The taut-leg mooring leg 402 employs a suction anchor 404 which may be of the type illustrated in FIGS. 4, 5, 6, 7, and 8 and described hereinabove in conjunction therewith. Alternatively, the taut-leg mooring leg 402 may employ a vertically loaded anchor of the type illustrated in FIGS. 34, 35, and 36 and described hereinabove in conjunction therewith. A 3-inch diameter, 1,500-foot long K4 ground chain 406 is connected to the suction anchor 404 and extends upwardly therefrom. A 3½-inch diameter, 8,500-foot long IWRC+20% catenary wire 408 is connected to the distal end of the ground chain 406 and extends upwardly therefrom. A 3-inch diameter, 15-foot long K4 buoy chain pendant 410 is connected between the distal end of the catenary wire 408 and a 82-kip fixed buoyancy submerged buoy 412. The buoy 412 is identical in construction and function to the buoy 356 illustrated in FIG. 9 and described hereinabove in conjunction therewith.

A 3½-inch diameter, 200-foot long IWRC–EIPS+20% intermediate connection pendant 414 is connected to the upper end of the buoy 412. A 3-inch diameter, 15-foot long K4 buoy chain pendant 416 extends between the distal end of the intermediate connection pendant 414 and a 57-kip adjustable buoyancy submerged buoy 418. The buoy 418 is identical in construction and function to the buoy 54 illustrated in FIGS. 9, 10, and 11 and described hereinabove in conjunction therewith.

A 3½-inch diameter, 400-foot long IWRC–EIPS+20% upper connection pendant 420 is connected to the upper end of the buoy 418. The distal end of the upper connection pendant 420 is in turn connected to a 3-inch diameter, 500-foot long K4 rig chain 422 extending from the MODU 38. Those skilled in the are will appreciate the fact that the taut-leg mooring leg 402 is typically not used singly, but rather is employed in conjunction with other, similar taut-leg mooring legs to properly stabilize the MODU at a drilling venue.

Figure 32:
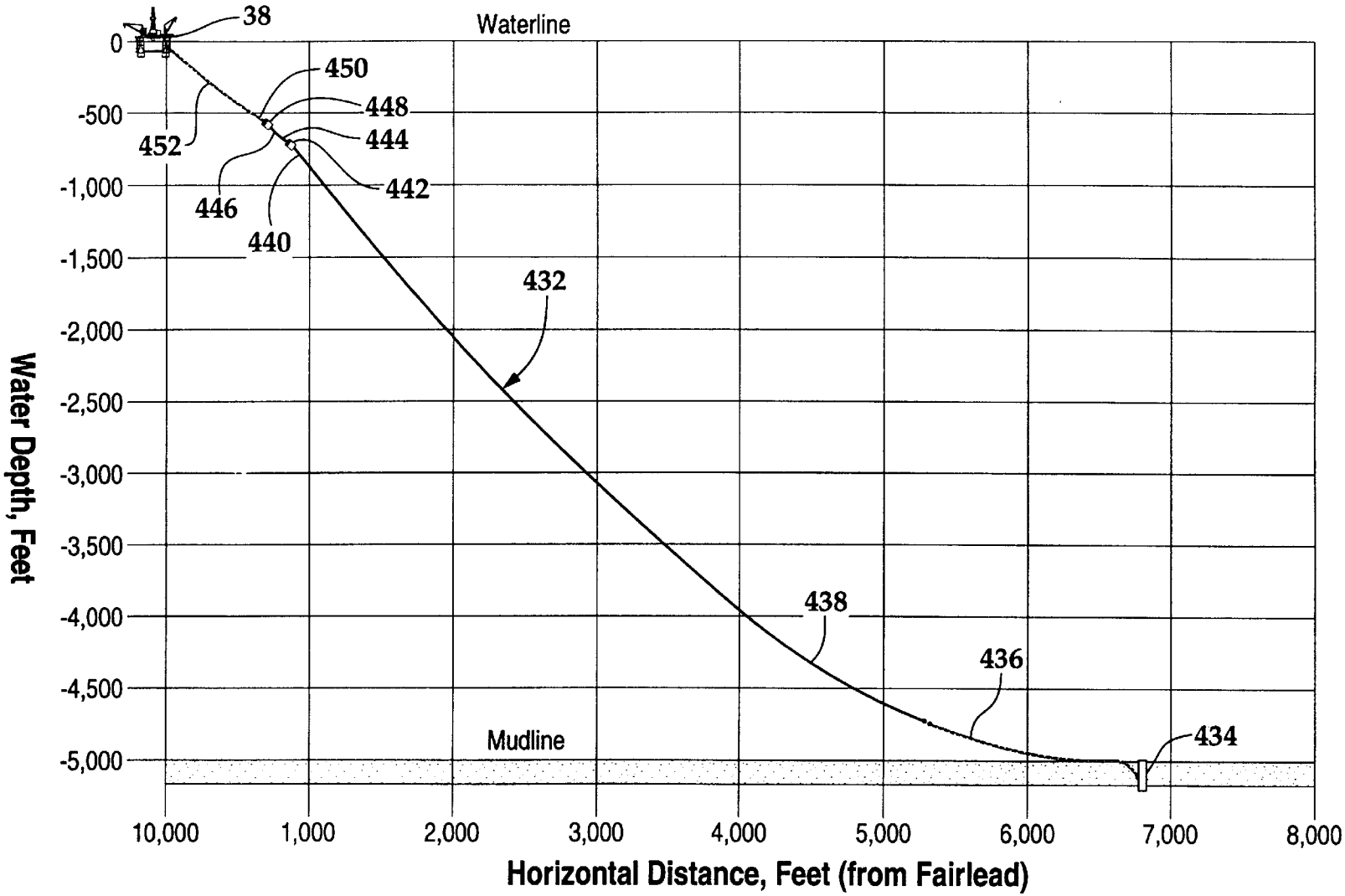
FIG. 32 is an illustration of a recoverable system for mooring mobile offshore drilling units comprising a fifth embodiment of the invention.

Referring now to FIG. 32, there is shown a taut-leg mooring leg 432 which may be used in the practice of the invention in lieu of the taut-leg mooring leg 42 illustrated in FIGS. 2 and 3 and described hereinabove in conjunction therewith. The taut-leg mooring leg 432 employs a suction anchor 434 which may be of the type illustrated in FIGS. 4, 5, 6, 7, and 8 and described hereinabove in conjunction therewith. Alternatively, the taut-leg mooring leg 432 may employ a vertically loaded anchor which may be either of the type illustrated in FIG. 34 or of the type illustrated in FIGS. 35 and 36 and described hereinabove in conjunction therewith.

A 3-inch diameter, 1,500-foot K4 ground chain 436 is connected to the anchor 434 and extends upwardly therefrom. A 3½-inch diameter, 6,000-foot long IWRC–EIPS+20% catenary wire 438 is connected to the distal end of the chain 436 and extends upwardly therefrom. A 3-inch diameter, 15-foot long K4 buoy chain pendant 440 is connected between the distal end of the catenary wire 438 and an 82-kip fixed buoyancy submerged buoy 442. The buoy 442 is identical in construction and function to the buoy 356 illustrated in FIG. 29 and described hereinabove in conjunction therewith.

A 3½-inch diameter, 200-foot long IWRC–EIPS+20% intermediate connection pendant 444 is connected to the upper end of the buoy 442. A 3-inch diameter, 15-foot long K4 buoy chain pendant 446 is connected between the distal end of the intermediate connection pendant 444 and a 17-kip adjustable buoyancy submerged buoy 448. The buoy 448 is identical in construction and function to the buoy 54 illustrated in FIGS. 9, 10, and 11 and described hereinabove in conjunction therewith.

A 3½-inch diameter, 400-foot long IWRC–EIPS+20% upper connection pendant 450 is connected to the upper end of the buoy 448. The upper connection pendant 450 is in turn connected to a 3-inch diameter, 500-foot long K4 rig chain 452 extending from the MODU 38. Those skilled in the art will appreciate the fact that the taut-leg mooring leg 432 is typically not employed singly, but rather is employed in conjunction with other, similar taut-leg mooring legs to properly stabilize the MODU 38 at a drilling venue.

Figure 33:
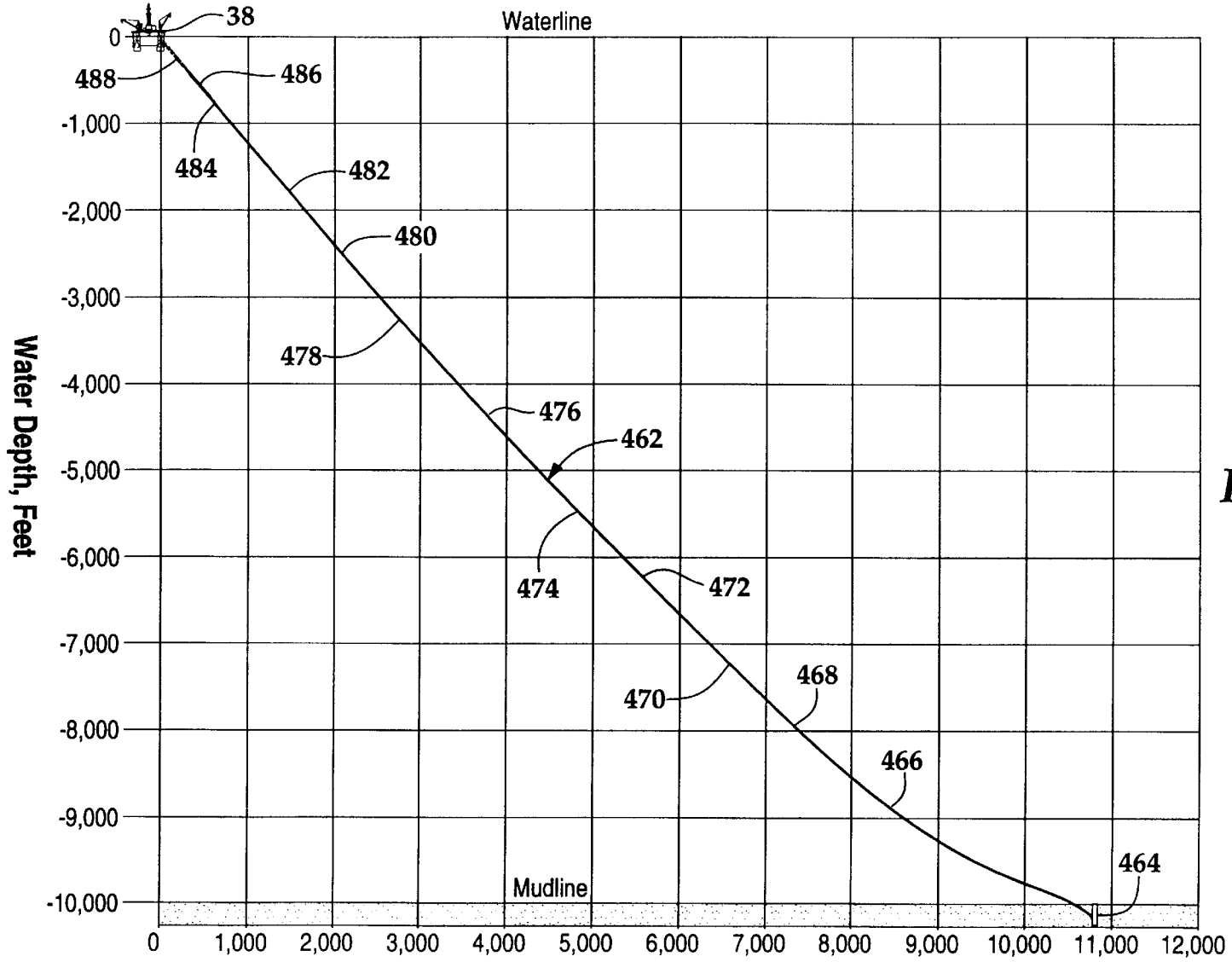
FIG. 33 is an illustration of a recoverable system for mooring mobile offshore drilling units comprising a sixth embodiment of the invention.

Referring now to FIG. 33, there is shown a taut-leg mooring leg 462 which may be utilized in the practice of the invention in lieu of the taut-leg mooring leg 42 illustrated in FIGS. 2 and 3 and described hereinabove in conjunction therewith. The taut-leg mooring leg 462 employs a suction anchor 464 which may be of the type illustrated in FIGS. 4, 5, 6, 7, and 8 and described herein in conjunction therewith. Alternatively, the taut-leg mooring leg 462 may employ a vertically loaded anchor, such as the vertically loaded anchor 346 illustrated in FIG. 34 or the vertically loaded anchor 348 illustrated in FIGS. 35 and 36 and described hereinabove in conjunction therewith.

A 3½-inch diameter, 4,000-foot long IWRC–EIPS+20% ground wire 466 is connected to the suction anchor 464 and extends upwardly therefrom. A 3-inch diameter, 5-foot long K4 chain 468 is connected to the distal end of the ground wire 466 and is in turn connected to a 6½-inch diameter, 2,400-foot long catenary segment 470 preferably comprising the polyester rope available from Marlow Ropes of the United Kingdom under the trademark "PolySuper." A 3-inch diameter, 5-foot long K4 chain 472 is connected between the "PolySuper" catenary segment 470 and a 6½-inch diameter, 2,440-foot long catenary segment 474 also comprising the "PolySuper" material. A 3-inch diameter, 5-foot long K4 chain 476 is connected between the "PolySuper" catenary segment 474 and a 6½-inch diameter, 2,400-foot long "PolySuper" catenary segment 478. A 3½-inch diameter, 5-foot long K4 chain 480 is connected between the "PolySuper" catenary segment 478 and a 6½-inch diameter, 2,400-foot long "PolySuper" catenary segment 482. A 3-inch diameter, 20-foot long K4 chain 484 is connected between the "PolySuper" catenary segment 482 and a 3½-inch diameter, 400-foot long IWRC–EIPS+20% wire for 486. The wire 486 is in turn connected to a 3-inch diameter, 500-foot long K4 rig chain 488 which extends from and is connected to the MODU 38.

Those skilled in the art will appreciate the fact the taut-leg mooring leg 462 differs considerably from the taut-leg mooring leg 42 illustrated in FIGS. 2 and 3 and described herein in conjunction therewith and from the taut-leg drilling legs 342, 372, 402, and 432 illustrated in FIGS. 29, 30, 31, and 32, respectively, and described hereinabove in conjunction therewith. This is because the taut-leg mooring leg 462 comprises segments 470, 474, 478, and 482 all of which are formed from "PolySuper", which has a submerged negative buoyancy about 13% that of steel rope of the same strength. The use of more buoyant materials in forming the connection between the anchor 464 and the rig chain 488 extending from and connected to the MODU unit eliminates the necessity of employing discrete submerged buoys within the taut-leg mooring leg 462, for example, the buoys 54 employed in the taut-leg mooring leg 42 of FIGS. 2 and 3, the buoys 356 and 358 of the taut-leg drilling leg 352 illustrated in FIG. 29, etc. Those skilled in the art will further appreciate the fact that the taut-leg mooring leg 462 is typically not employed singly, but rather is employed in combination with other, similar taut-leg mooring legs in order to properly stabilize the MODU 38 at a drilling venue in the manner illustrated in FIG. 1 and described hereinabove in conjunction therewith.

Although preferred and alternative embodiments of the invention have been illustrated in the accompanying Drawings and described in the foregoing Detailed Description, it will be understood that the invention is not limited to the embodiments disclosed, but is capable of numerous rearrangements and substitutions of parts and elements without departing from the spirit of the invention.

We claim:

1. For use in a mooring line extending from the sea floor to the sea surface, a variable buoyancy buoy comprising:

a frame having first and second ends;

a first buoyancy member mounted on the frame;

a second buoyancy member removably mountable on the frame to selectively change the buoyancy of the buoy when being used onsite;

means for securing the second buoyancy member on the frame; and means located at the first and second ends of the frame for securing the buoy in the mooring line.

2. The variable buoyancy buoy according to claim 1 further characterized by a plurality of second buoyancy members each removably mountable on the frame to selectively change the buoyancy of the buoy, and the means for securing the second buoyancy members in engagement with the frame.

3. The variable buoyancy buoy according to claim 2 wherein the first buoyancy member and the second buoyancy members are formed from syntactic foam.

4. The variable buoyancy buoy according to claim 3 wherein the frame includes a shaft extending through the first buoyancy member, a fixed plate comprising one end of the frame and secured to the shaft in engagement with the first buoyancy member, and a second plate comprising the opposite end of the frame and selectively engageable with the shaft for securing a selected number of the buoyancy members in engagement therewith.

5. The variable buoyancy buoy according to claim 4 wherein the securing means comprises a fastener extending through the second plate and the shaft for securing the second plate and the variable buoyancy members in engagement with the shaft.

6. A variable buoyancy buoy comprising:

a frame having first and second ends;

a first plate securably mounted to the first end of the frame;

a second plate selectively positionable along the frame between the first and second ends of the frame;

a first buoyancy member mounted on the frame adjacent to the first plate; and a second buoyancy member removably mountable on the frame between the first buoyancy member and the second plate, whereby the second plate is selectively positioned along the frame proximate the second buoyancy member when being used in operation to change the buoyancy of the buoy.

7. The variable buoyancy buoy according to claim 6 further comprises a third buoyancy member removably mountable on the frame between the second buoyancy member and the first buoyancy member.

8. The variable buoyancy buoy according to claim 7 further comprises a fourth buoyancy member removably mountable on the frame between the second buoyancy member and the first buoyancy member.

9. The variable buoyancy buoy according to claim 8 further comprises a fifth buoyancy member removably mountable on the frame between the second buoyancy member and the first buoyancy member.

10. The variable buoyancy buoy according to claim 6 wherein the first buoyancy member and the second buoyancy member are formed from syntactic foam.

11. The variable buoyancy buoy according to claim 6 further comprises first and second pad eyes respectively positioned on the first and second ends of the shaft.

12. A variable buoyancy buoy comprising:

a frame having first and second ends;

a first plate securably mounted to the first end of the frame;

a second plate selectively positionable along the frame between the first and second ends of the frame;

a first buoyancy member mounted on the frame adjacent to the first plate; and a second buoyancy member removably mountable on the frame between the first buoyancy member ad the second plate, whereby the second plate is positioned along the frame proximate the second buoyancy member, wherein the frame further comprises a shaft including a plurality of spaced apart holes along at least a portion of a length of the shaft that receive a fastener extending through the second plate such that the second plate may be positioned in a plurality of locations along the shaft.

* * * * *

UNITED STATES PATENT AND TRADEMARK OFFICE

CERTIFICATE OF CORRECTION

PATENT NO. : 6,309,269 B1
DATED : October 30, 2001
INVENTOR(S) : Fulton et al.

It is certified that error appears in the above-identified patent and that said Letters Patent is hereby corrected as shown below:

Title page,
Under "OTHER PUBLICATIONS"
"Marine Contactors" should read -- Marine Contractors --.

Column 6,
Line 1, "and the is" should read -- and the --.

Column 11,
Line 60, the word "are" should read -- art --.

Column 14,
Line 54, the word "ad" should read -- and --.

Signed and Sealed this

Twenty-eighth Day of May, 2002

*Attest:*

*Attesting Officer*

JAMES E. ROGAN
*Director of the United States Patent and Trademark Office*